US010011336B2

(12) United States Patent
Bhattacharyya et al.

(10) Patent No.: US 10,011,336 B2
(45) Date of Patent: Jul. 3, 2018

(54) UNDERWATER VEHICLE DESIGN AND CONTROL METHODS

(71) Applicant: Massachusetts Institute of Technology, Cambridge, MA (US)

(72) Inventors: Sampriti Bhattacharyya, Cambridge, MA (US); Haruhiko Harry Asada, Lincoln, MA (US); Michael S. Triantafyllou, Belmont, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 15/060,575

(22) Filed: Mar. 3, 2016

(65) Prior Publication Data

US 2016/0257386 A1 Sep. 8, 2016

Related U.S. Application Data

(60) Provisional application No. 62/127,489, filed on Mar. 3, 2015, provisional application No. 62/127,510, filed on Mar. 3, 2015.

(51) Int. Cl.
*B63G 8/08* (2006.01)
*B63G 8/00* (2006.01)

(52) U.S. Cl.
CPC ..... *B63G 8/001* (2013.01); *B63G 8/08* (2013.01)

(58) Field of Classification Search
CPC ..... B63G 8/00; B63G 8/001; B63G 8/08
USPC ..... 114/312, 313, 330, 331, 337
See application file for complete search history.

(56) References Cited

U.S. PATENT DOCUMENTS

| | | | | |
|---|---|---|---|---|
| 2,969,032 | A | 1/1961 | Pinnes | |
| 3,090,455 | A | 5/1963 | Crowley | |
| 3,127,863 | A | 4/1964 | Tinajero | |
| 3,302,602 | A | 2/1967 | Korganoff | |
| 3,661,111 | A | 5/1972 | Lippisch | |
| 5,852,651 | A | 12/1998 | Fischer et al. | |
| 5,947,051 | A * | 9/1999 | Geiger | B62D 57/00 114/222 |
| 6,554,674 | B1 | 4/2003 | Thorne, III | |
| 7,020,490 | B2 | 3/2006 | Khatri | |
| 7,058,363 | B2 | 6/2006 | Hottinen et al. | |
| 8,220,408 | B2 | 7/2012 | Stone et al. | |
| 8,820,261 | B2 | 9/2014 | Lambertus | |
| 8,843,084 | B2 | 9/2014 | Pescod et al. | |
| 8,989,294 | B2 | 3/2015 | Sun et al. | |
| 9,032,901 | B1 | 5/2015 | Braun et al. | |
| 9,586,661 | B1 | 3/2017 | Braun et al. | |

(Continued)

FOREIGN PATENT DOCUMENTS

| | | | |
|---|---|---|---|
| FR | 1471538 | A | 3/1967 |
| WO | WO 01/79055 | A1 | 10/2001 |

OTHER PUBLICATIONS

International Search Report and Written Opinion for PCT/US2016/020791 dated May 16, 2016.

(Continued)

*Primary Examiner* — Daniel V Venne
(74) *Attorney, Agent, or Firm* — Wolf, Greenfield & Sacks, P.C.

(57) ABSTRACT

Vehicles designed to use ground effect forces to control a positioning of the vehicle relative to a surface as well as their methods of use are described.

28 Claims, 27 Drawing Sheets

(56) References Cited

U.S. PATENT DOCUMENTS

| | | | | |
|---|---|---|---|---|
| 2007/0022935 | A1* | 2/2007 | Griffith | B63C 11/02 114/312 |
| 2008/0300742 | A1* | 12/2008 | Weaver | B63C 11/40 701/21 |
| 2012/0257704 | A1 | 10/2012 | Asada et al. | |
| 2012/0282826 | A1 | 11/2012 | Asada et al. | |
| 2014/0107839 | A1 | 4/2014 | Asada et al. | |
| 2014/0165898 | A1 | 6/2014 | Cierpka et al. | |
| 2014/0360420 | A1 | 12/2014 | Scott et al. | |
| 2015/0078488 | A1 | 3/2015 | Lee et al. | |
| 2016/0129979 | A1* | 5/2016 | Rossano | B63G 8/001 114/333 |
| 2016/0257385 | A1 | 9/2016 | Bhattacharyya et al. | |

OTHER PUBLICATIONS

Hardesty, Underwater robot for port security. MIT News. Sep. 26, 2014. Retrieved from the Internet on Apr. 18, 2016. Accessed at http://news.mit.edu/2014/underwater-robot-for-port-security-0926. 3 pages.

International Preliminary Report on Patentability dated Sep. 14, 2017 for Application No. PCT/US2016/020788.

International Preliminary Report on Patentability dated Sep. 14, 2017 for Application No. PCT/U52016/020791.

Bhattacharyya et al., Control of a compact, tetherless ROV for in-contact inspection of complex underwater structures. Proceedings of the 2014 IEEE/RSJ International Conference on Intelligent Robots and Systems (IROS 2014), Chicago, IL, Sep. 14-18, 2014. pp. 2265-2272.

Bhattacharyya et al., Design analysis of a self stabilizing underwater sub-surface inspection robot using hydrodynamic ground effect. Published in OCEANS 2015—Genova, IEEE, May 2015. 7 pages.

Bhattacharyya et al., A self stabilizing underwater sub-surface inspection robot using hydrodynamic ground effect. Proceedings of the 2015 IEEE International Conference on Robotics and Automation (ICRA), Seattle, WA, May 26-30, 2015 . pp. 1573-1580.

Kotansky et al., A basic study of the VTOL ground effect problem for planar flow. J Aircraft. Apr. 1978:15(4): 214-21.

Levin et al., Single jet-induced effects on small-scale hover data in ground effect. J. Aircraft. May-Jun. 1997;34(3):400-7.

* cited by examiner

UNDERWATER VEHICLE DESIGN AND CONTROL METHODS

CROSS-REFERENCE TO RELATED APPLICATIONS

This application claims the benefit of priority under 35 U.S.C. § 119(e) of U.S. Provisional Application No. 62/127,510, filed Mar. 3, 2015, and U.S. Provisional Application No. 62/127,489, filed Mar. 3, 2015, the disclosures of each of which are incorporated by reference in their entirety.

GOVERNMENT FUNDING

This invention was made with Government support under Grant No. CMMI1363391 awarded by the National Science Foundation. The Government has certain rights in the invention.

FIELD

Disclosed embodiments are related to underwater vehicle designs and control methods.

BACKGROUND

A great deal of research has been done in marine robotics to develop sophisticated systems for inspection and maintenance of structures. For example, applications for such a vehicle include inspection of underwater infrastructures, pipelines, dams, oil rig supports, as well as the internal systems of a boiling water nuclear reactor to name a few. Additionally, these inspections require both close-up visual inspection and on-contact inspection to test for external and internal structural flaws. In another application such as port security, careful on contact ultrasound scanning and visual imaging of ship hulls are areas of immense interest to prevent smuggling of contraband. At present, human divers and the US Navy's multi-million dollar marine mammal program, which deploys dolphins, are often required to undertake such risky missions. However, these programs are not easily scalable. To reduce the risk to human divers, and find a scalable solution, considerable effort is currently going into sub-sea robotics. However, typical submerged surface inspection robots are large complex systems that use various combinations of wheels, magnets, and/or vacuum suction to move across a submerged surface. The effort required to control these systems is high, and these systems are often times tethered. Therefore, the resulting inspection process is slow and does not have the discreteness required for various types of detection.

SUMMARY

In one embodiment, a vehicle has a hull including a first portion having a partial ellipsoidal shape and a second portion that is flat and associated with the first portion. The vehicle also includes one or more sensors configured to sense information from a surface the flat second portion of the hull is oriented towards.

In another embodiment, a vehicle has a hull including a flat portion and one or more sensors configured to sense information from a surface the flat portion of the hull is oriented towards. The sensors have a desired sensing range from the flat portion of the hull. Further, a chord length of the flat portion of the hull results in at least one stable equilibrium position relative to the surface within the desired sensing range when the vehicle is moved laterally relative to the surface.

In yet another embodiment, a vehicle has a hull including a flat portion and at least one thruster associated with the flat portion of the hull. The at least one thruster has a diameter and a thrust capacity. The vehicle also includes one or more sensors configured to sense information from a surface the flat portion of the hull is oriented towards. The sensors have a desired sensing range from the flat portion of the hull. Further, the diameter of the at least one thruster is appropriately sized and the thrust capacity is sufficient to provide at least one stable equilibrium stable equilibrium position within the desired sensing range when the vehicle is located adjacent to the surface.

In another embodiment, a method of controlling a vehicle immersed in a fluid includes: positioning the vehicle immersed in a fluid at a first preselected distance relative to a surface; and applying a ground effect force to the vehicle to maintain the vehicle at the first preselected distance.

In yet another embodiment, a method of controlling a vehicle immersed in a fluid includes: applying a ground effect force to the vehicle at a first stable equilibrium distance of the ground effect force relative to a surface such that the ground effect force biases the vehicle towards the first stable equilibrium distance when it is displaced relative to the surface.

In another embodiment, a method of controlling a vehicle immersed in a fluid includes: orienting a flat portion of the vehicle towards a surface; applying a thrust to the vehicle that biases the vehicle towards the surface; and applying a ground effect force to the vehicle relative to the surface, wherein the net weight of the vehicle, the net thrust biasing the vehicle towards the surface, and the ground effect force associated with the surface result in a substantially net zero force applied to the vehicle in a direction oriented towards the surface.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1A:
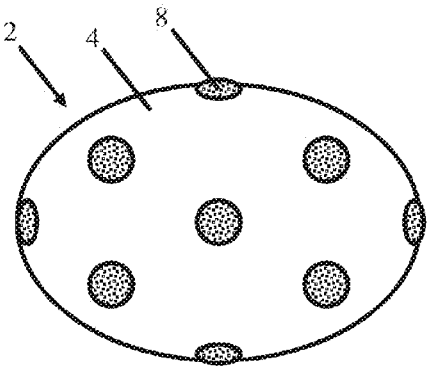
FIG. 1A is a schematic top view of one embodiment of a partial ellipsoidal vehicle with a flat bottom including thrusters and sensors.
Figure 2A:
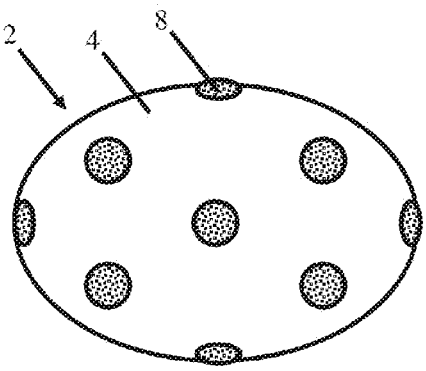
FIG. 2A is a schematic top view of one embodiment of a partial ellipsoidal vehicle with a flat bottom including thrusters and sensors.
Figure 1B:
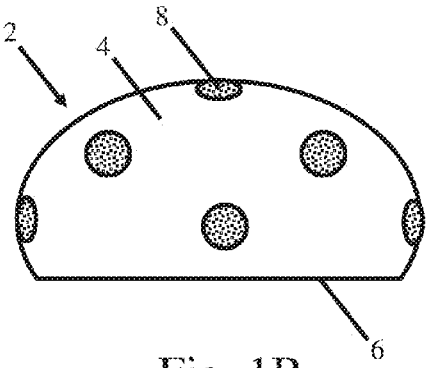
FIG. 1B is a side view of the embodiment of the vehicle shown in FIG. 1A.
Figure 2B:
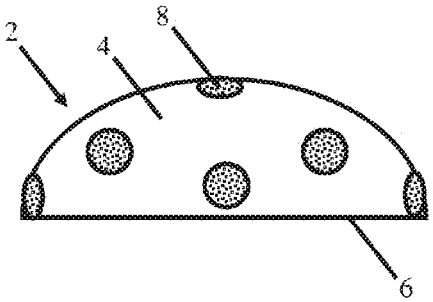
FIG. 2B is a side view of the embodiment of the vehicle shown in FIG. 2A.

In view of the limitations of on contact inspection vehicles, such as slow speeds, and control difficulties, the inventors have recognized the benefits associated with vehicles capable of operating in a non-contact mode either within a structure and/or near a surface of interest. Such a vehicle may provide faster and more reliable operation for applications such as various types of inspection without being disturbed by the surface roughness, irregularities, or other varying properties of a surface or area being inspected, though instances in which the vehicles disclosed herein are operated in a contact mode are also contemplated. For example, such a vehicle may be of particular benefit in applications such as port security as well as inspection and maintenance of underwater infrastructures, pipelines, dams, oil rig supports, as well as the internal systems of a boiling water nuclear reactor to name a few where high speed accurate inspection may be advantageous. While specific applications are noted above, the disclosed vehicles may be applied to any number of other applications.

In order to enable non-contact control of a vehicle relative to a surface, the inventors have recognized a need to develop vehicle geometries and control methods to maintain a controlled gap of the vehicle relative to the surface. While it may be possible to implement a tight feedback control to regulate the gap, in an underwater environment, such a brute force control method would likely require powerful and extremely fast responding actuators. Therefore, in addition to any appropriate feedback control loops used, the inventors have recognized the benefits associated with using hydrodynamic effects between the vehicle and the inspection surface to automatically control movements of the vehicle relative to the inspection surface. Namely, the inventors have developed vehicle geometries and control methods that exploit the so called 'ground effect' forces that change fluid behavior near a surface to control the vehicle in a variety of ways as detailed further below.

While the term ground effect is used to describe the phenomenon that generates the forces experienced by a vehicle when it is in close proximity to a surface, it should be understood that the phrase ground effect is not limited to only situations where a vehicle is generating forces due to it being proximate to the ground. Instead, the phrases, ground effect, ground effect force, or any related phrase, are applicable to operation of a vehicle proximate to any surface including, but not limited to, the ground, a sea bed, a river bed, a ship hull, the interior of a pipe, as well as immersed structures (e.g. dams and oil rig supports) to name a few.

In some embodiments, the ground effect forces applied to a vehicle in various ways can be manipulated to self-stabilize a vehicle at a desired distance relative to a surface. For instance, the embodiments and examples described herein illustrate how competing suction and lift forces associated with the ground effect, along with other forces applied to the vehicle, can be balanced to create a stable net zero force, or equilibrium, position at one or more distances relative to a surface. Due to the change in force with distance relative to the surface at these stable equilibrium positions, as the vehicle is displaced away from a stable net zero force position, the net force changes to bias the vehicle back towards the stable position. For example, in one embodiment, below a stable equilibrium position, lift forces begin to dominate biasing the vehicle upwards away from the surface and towards the stable equilibrium position. Correspondingly, above the stable equilibrium position suction forces begin to dominate biasing the vehicle downwards back towards the surface and the stable equilibrium position. Thus, the ground effect forces can be utilized to implement a self-stabilizing control method which may be used in place of, or in combination with, other control methods for controlling the gap between a vehicle and a surface of interest. In view of this effect, in some embodiments, a net force applied to a vehicle relative to a relative to a surface may decrease (i.e. suction dominates more) with increasing distance to the surface. Of course, the absolute value of this change in force relative to the distance will depend on the vehicle size, speeds, applied thrusts, gap distance, and desired applications to name a few. Therefore, it should be understood that any appropriate range of values for a desired application may be used.

While negative changes in net force versus gap distance are noted above with regards to stable equilibrium points above, it should be understood that a vehicle may be operated either dynamically, and/or statically, in a region where the changes in net force versus gap distance are positive. Such operation simply would not be self-stabilizing as described above.

Various types of ground effect forces may be applied to a vehicle to help control the movement and positioning of the vehicle relative to a surface. Further, depending on the particular mode of operation, any one of these types of ground effect forces may be used either alone, or in combination with other types of ground effect forces, as well as other forces acting on the vehicle, to control the vehicle's positioning and motion. Specific types of ground effect forces are detailed further below.

In one embodiment, a vehicle may generate a ground effect force due to lateral motion of the vehicle relative to the surface. In such an embodiment, and without wishing to be bound by theory, the lateral movement of the vehicle relative to the surface (i.e. approximately parallel to the surface) causes the flow of fluid under the vehicle to speed up as compared to the velocity of the vehicle through the fluid. This may cause suction at a first distance and repulsion from the surface at a second closer distance due to choking. In some embodiments, a self-stabilization equilibrium point may be located between these distance.

In another embodiment, a vehicle may include one or more thrusters that are configured to be oriented towards a surface of interest. Depending on the diameter of the thruster, the applied thrust, and a distance from the surface, the one or more jets may create a variety of ground effects. For instance, a jet of fluid from the thruster may generate a wall effect which creates a lateral flow of fluid between the vehicle and surface causing a low pressure zone that sucks the vehicle towards the surface. The jet may also create vortices, also known as a Venturi effect, that also creates a suction force on the vehicle. There is also an upward force applied to the vehicle, in addition to a normal thrust force from the thruster, due to an observed fountain effect corresponding to the jet being reflect from the surface towards the vehicle. The domains where these various effects dominate, and how they may be used together to control of a vehicle, are described in further detail below.

While any appropriately shaped and sized vehicle may be used with the described systems and methods, the inventors have recognized the benefits associated with using particular vehicle shapes. For example, in some embodiments, it may be desirable to reduce the stresses applied to a vehicle while under compression when the interior is not flooded. Thus, a smooth surface with smooth changes in curvature may be used. In one example, a sphere may be used. However, a sphere may lead to control and stability issues. Therefore, in another embodiment, an ellipsoid may be used which is better suited for movement using five degrees of freedom. Additionally, shapes such as spheres and ellipsoids beneficially help to maximize the volume to surface area ratio for a particular size vehicle. The mentioned ellipsoids may have any desired aspect ratio including but not limited to a ratio of the major to minor axes between or equal to 1 to 2, 1.4 to 1.65, or any other appropriate ratio. Additionally, asymmetric ellipsoids may be used where one half of the ellipsoid has a first aspect ratio and the other opposing half of the ellipsoid may have a different aspect ratio which may help to enhance a ground effect experienced by the vehicle. While various arrangements of spheres and ellipsoids are mentioned above, it should be understood that a vehicle may have any desired shape as the disclosure is not limited in this fashion.

Depending on the particular application, a vehicle may have any desired maximum outer dimension. For example, in one embodiment, a vehicle may have a maximum outer dimension that is between or equal to 5 inches and 60 inches, 24 inches and 48 inches, or any other appropriate size range for the desired application. Therefore, it should be understood that vehicles having outer dimensions that are both smaller and larger than those noted above including large vehicles with dimension on the order of tens of yards or feet are also contemplated.

In addition to the overall shape of a vehicle, the inventors have recognized that the addition of a flat portion on the vehicle hull that may be oriented towards a surface of interest. In some embodiments, this flat portion of the hull may be sized and shaped to enhance the observed ground effect forces, enhance stability of the vehicle as it moves through a fluid, and/or help position sensors relative to the surface for conducting surface inspections. Depending on the particular embodiment, the flat portion of the hull may have an area that is between or equal to 10% and 100%, 20% and 100%, 30% and 100%, 50% and 100%, 20% and 80%, or any other appropriate range of percentages of a projected area of the hull oriented towards the flat portion of the hull. For instance, a half ellipsoid shape corresponding to a flat hull portion that has an area equal to a projected area of the associated ellipsoidal portion of the hull may provide a relatively large area for sensors which might be useful in mapping applications where a vehicle is moved relative to the sea bed surface using ground effect forces while mapping the area with the larger number of sensors associated with the flat portion of the hull.

It should be understood that the vehicle hull and various other components described herein may be made from any appropriate material. For example, a hull may be made from various metals, polymers, ceramics, and/or a combination of these materials. Additionally, in some embodiments, a flat portion of the hull meant to be oriented towards a surface of interest may be made from an elastic material, such as an elastomer (e.g. rubber, polyisoprene, polybutadiene, polyisobutylene, polyurethane, etc.). Without wishing to be bound by theory, such a surface may help smooth the response of a vehicle as it traverses a surface including irregularities either in a contact and/or a standoff mode.

While a vehicle capable of maintaining a distance relative to a surface may be applicable in a number of applications, such a vehicle may be of particular benefit to when used to carryout various types of inspections and/or maintenance. For example, as noted above, in some embodiments, a vehicle may include one or more sensors for sensing information about a surface such as the hull of a ship, the bottom of a sea bed, or any other object or place of interest. Appropriate types of sensors that may be used include, but are not limited to, ultrasonic sensors, eddy current detectors, magnetic sensors, cameras, optical sensors, temperature sensors, pressure sensors, PH sensors, turbidity sensors, oxygen sensors, carbon dioxide sensors, linear sensor arrays, phased sensor arrays, as well as any other appropriate type and/or arrangement of sensors.

In some embodiments, depending on the type of sensor used, a sensor may have a desired sensing range that it is desirable to maintain the sensor within when sensing information from a surface. In one such embodiment, a sensor, such as an ultrasonic sensor, has a preferred sensing range related to a wavelength of the ultrasonic wave. Specifically, when the sensor is placed at an odd multiple of a quarter wavelength away from the surface, the overlapping waves add in phase at the transducer creating a signal maximum. In contrast when the sensor is located at an even multiple of the quarter wavelength, the waves cancels and the signal is at its minimum. Therefore, in some embodiments, a sensing range for an ultrasonic sensor may be an odd multiple ±0.5 of a quarter wavelength. In one such example, a 300 KHz ultrasonic transducer has a wavelength of 4 mm in water ($c_w$=1500 m/s) which translates to a 1 mm quarter wavelength. So, the maximum signal is obtained at 1×n mm from the surface, where n is an odd number.

Based on the foregoing concepts, in one embodiment, a vehicle immersed in a fluid may at least partially be controlled by positioning the vehicle at a preselected distance relative to a surface such as the hull of a ship or a seabed. In some instances the preselected distance may correspond to a stable equilibrium distance of the vehicle relative to the surface. Once appropriately positioned, one or more ground effect forces may be applied to the vehicle to maintain the vehicle at the first preselected distance by creating a net zero force applied to the vehicle at the preselected distance relative to the surface of interest. For example, the various types of ground effect forces applied to the vehicle, the net weight of the vehicle (i.e. actual weight minus buoyancy), along with any other forces applied to the vehicle from a sources such as an associated thruster may sum to zero in a direction oriented towards the surface. When the vehicle is displaced away from the preselected distance relative to the surface, the ground effect forces may change to automatically bias the vehicle back towards the desired preselected distance relative to the surface. As described in more detail below, the ground effect forces may be generated using lateral movement of a vehicle relative to the surface, jets impinging on the surface, and/or a combination of both.

Turning now to the figures, several non-limiting embodiments are described in further detail. However, while specific embodiments are described, it should be understood that the various features and concepts described below may be used in any appropriate combination as the disclosure is not limited to only those embodiments described herein.

FIGS. 1A-2C depict various schematic views of embodiments of a vehicle 2 that is submersible in a fluid, such as water. The vehicle includes a hull including a first portion 4 and a second flat portion 6. As illustrated in the figures, the first portion of the hull may be a gently curved structure such as a partial ellipsoid, spheroid, or other appropriate shape with the flat portion forming a flat bottom surface of the vehicle. However, shapes including non-gently curved shapes and features are also envisioned as the disclosure is not so limited. Additionally, depending on the particular application and or design criteria, the flat portion of the vehicle hull may have an area that is any appropriate percentage of the projected area of the corresponding portion of the hull.

To control maneuvering of a vehicle, in some embodiments, a plurality of thrusters 8 are distributed around the first portion of the hull 4. These thrusters may be oriented in any number of desired ways to provide thrust in various directions. For example, thrusters may be positioned and oriented to provide thrust in directions that are oriented vertically downwards and/or laterally relative to the flat bottom portion 6 of the vehicle. Of course thrusters that are oriented at an angle that provide both vertical and lateral thrust components to the vehicle are also envisioned. Further, in some instances, these thrusters may apply their thrusts to the vehicle along an axis that passes through a center of gravity of the vehicle. Without wishing to be bound by theory, this may help to eliminate, or reduce, unwanted moments being applied to the vehicle during maneuvering.

In addition to the thrusters located on the ellipsoidal portion of the hull noted above, in some embodiments, one or more thrusters may also be associated with a flat portion of the vehicle hull 6 to provide a thrust directed upwards relative to the flat bottom portion of the hull. For instance, a central thruster 10 may be located approximately in a center of the flat portion and may apply a thrust that is oriented perpendicular to the flat surface. Additionally, a plurality of thrusters 12 may be distributed about the flat portion of the vehicle as well. In some instances, the plurality of thrusters are evenly distributed around the flat portion of vehicle and/or around a periphery of the flat portion. As depicted in the figures in one such embodiment, the plurality of thrusters include two or more thrusters that are located on opposing sides of the central thruster. Without wishing to be bound by theory, this may help to balance the thrusts applied to the vehicle during operation. However, embodiments in which the thrusters are arranged in an uneven fashion or in other locations, are also contemplated. Further, as described in more detail below, the thrusters associated with the flat bottom hull portion may either be oriented perpendicularly, or angled relative to, the flat portion of the hull depending on the desired vehicle control.

For the sake of clarity, the thrusters noted in the above description, and illustrated in the figures, correspond to thruster outlets. However, it should be understood that the depicted structures may correspond to either thruster outlets or inlets, which again, may be disposed on any appropriate portion of the vehicle as the disclosure is not so limited. For example, in one embodiment the vehicle may include a plurality of thruster outlets disposed on a top, bottom, front, and back of the vehicle relative to a primary direction of travel. Correspondingly, the associated one or more thruster inlets may be disposed on the sides of the vehicle. It is noted though, that other locations of both the thruster inlets and outlets are also contemplated. Further, in instances where an interior of a vehicle is flooded during use, a vehicle may or may not include any thruster inlets formed in an exterior of the vehicle.

In the embodiments described herein, a thruster may refer to any appropriate device capable of applying a thrust to a vehicle for controlling the motion of the vehicle. Appropriate types of thrusters include, but are not limited to, pressure jets, maneuvering jets, tunnel thrusters, as well as propellers to name a few. In instances where a jet, or other similar device, is used, any appropriate hydraulic power source may be used to power the jet including rotary pumps, centrifugal pumps, gear pumps, reciprocating pumps, turbines as well as any number of other types of devices. In instances where it may be desirable to provide a relatively constant, or more controlled thrust, pressure reservoirs such as accumulators may be connected between the hydraulic pressure source and an outlet from the jet. Additionally, individual valves and/or power sources may be associated with each thruster to provide individual and/or grouped control of the thrusters. However, in some embodiments, one or more pressure distribution systems may be used to fluidly couple a pressure source with multiple thrusters which may help to reduce the size and complexity of the vehicle.

Figure 1C:
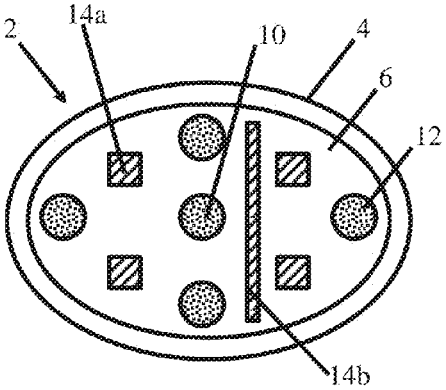
FIG. 1C is a bottom view of the embodiment of the vehicle shown in FIG. 1A.
Figure 2C:
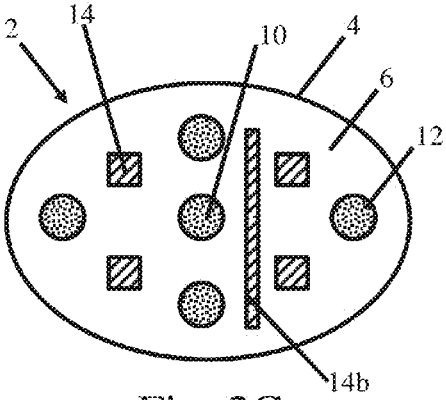
FIG. 2C is a bottom view of the embodiment of the vehicle shown in FIG. 2A.

As mentioned previously, a vehicle may include one or more sensors. Additionally, a flat hull portion may be an especially beneficial location in which to position the sensors for sensing information from a surface of interest. For example, a flat surface provides more area in which to locate a variety of sensors for inspecting a surface permitting the use of larger sensors, sensor arrays, and/or a larger number of sensors. As shown in FIGS. 1C and 2C, individual sensors 14*a* may be distributed around the flat portion of the hull. Alternatively, or in addition to the plurality of individual sensors, a vehicle may also include an array of sensors 14*b*. In the depicted embodiment, the array of sensors extend at least partially across a width of the flat hull portion. This increased area and/or length the sensors are disposed over may increase the detectable threshold of the sensors, a fidelity of the sensed signal, and/or an area scanned by the sensors during a single pass when inspecting a surface. In the depicted embodiment, the sensor array extends in a direction that is substantially perpendicular to a primary direction of travel of the vehicle, though, embodiments in which the array extends in a direction that is substantially parallel to a primary direction of travel of the vehicle are also contemplated. In addition to larger areas to accommodate sensors, the use of a flat hull portion permits two or more sensors and/or a transmitter and associated receiver to be located in the same plane when inspecting a surface. This may be of benefit in a variety of applications, including, but not limited to triangulating a distance to a particular feature on a surface using three distance sensors located in the same plane corresponding to the flat hull portion.

Figure 3:
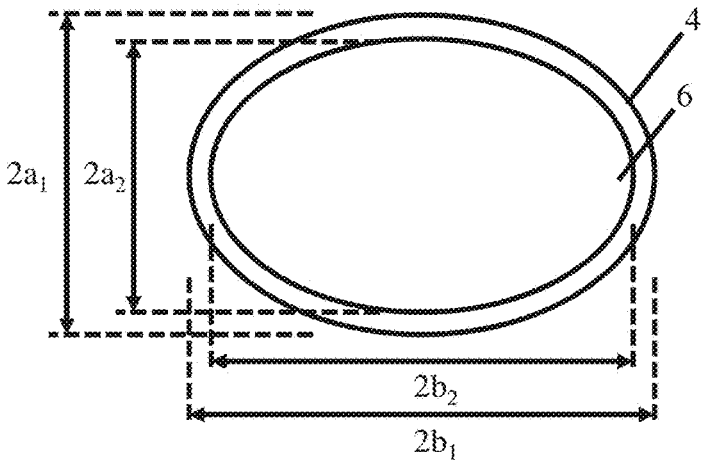
FIG. 3 is a bottom view of a partial ellipsoidal vehicle with a flat bottom including labeled dimensions.
Figure 4:
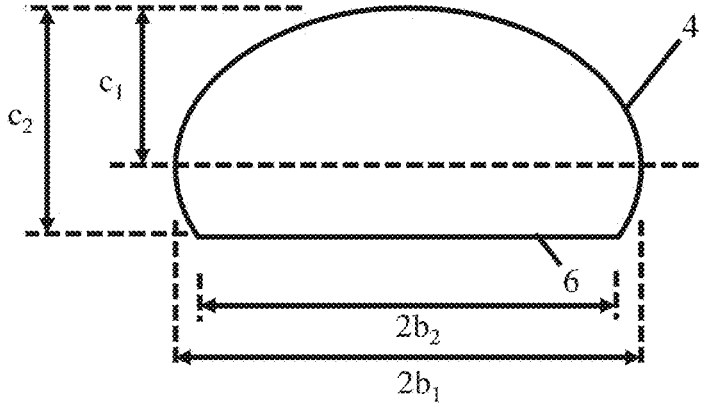
FIG. 4 is a side view including labeled dimensions of the vehicle shown in FIG. 3.
Figure 5:
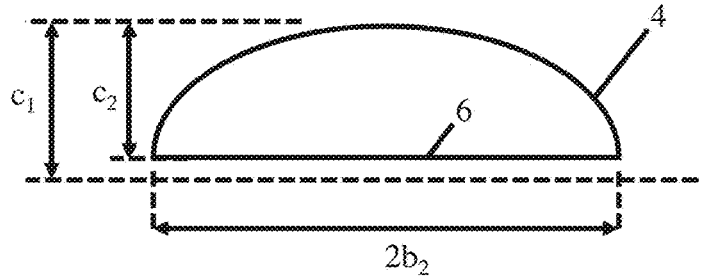
FIG. 5 is a side view of a partial ellipsoidal vehicle with a flat bottom including labeled dimensions.

FIGS. 3-5 show bottom and side views of a vehicle hull including a first portion 4 that has a partial ellipsoidal shape and an associated second flat portion 6. The partial ellipsoidal portion of the hull has principle radii $a_1$, $b_1$, and $c_1$. As seen in the figures, the flat hull portion corresponds to where a portion of the ellipsoid has been removed creating a flat ellipsoid with principle radii $a_2$ and $b_2$. As illustrated by FIGS. 4 and 5, the flat portion of the hull may be located either above or below a central plane of the ellipsoidal shape that is parallel to the flat hull portion. Thus, depending on the particular embodiment, a distance $c_2$ from the flat hull portion to an opposing apex of the ellipsoidal shape may be less than, greater than, or equal to, the principle radii $c_1$ of the partial ellipsoidal shape. Correspondingly, an area of the flat portion, which in FIG. 4. is $\pi a_2 b_2$, may be less than or equal to a projected area of the first portion of the hull oriented towards the flat hull portion which again in FIG. 4 corresponds is $\pi a_1 b_1$. However, as shown in FIG. 5, when the flat portion of the hull is located at or above the central plane of the partial ellipsoidal shape, the projected area of the first portion of the hull is equal to the area of the flat hull portion. Thus in addition to the above noted relations of the areas, a distance between an opposing side of the first portion of the hull and the flat hull portion (i.e. $c_2$) may be between or equal to 10% and 80%, 10% and 70%, 10% and 60%, 10% and 50%, or any other appropriate percentage of a corresponding width of the ellipsoid corresponding to the first portion of the hull (i.e. $2c_1$). While the areas and distances noted above have been in reference to an ellipsoidal shape, these concepts may be applied to any other appropriate shape as the disclosure is not so limited.

Figure 6:
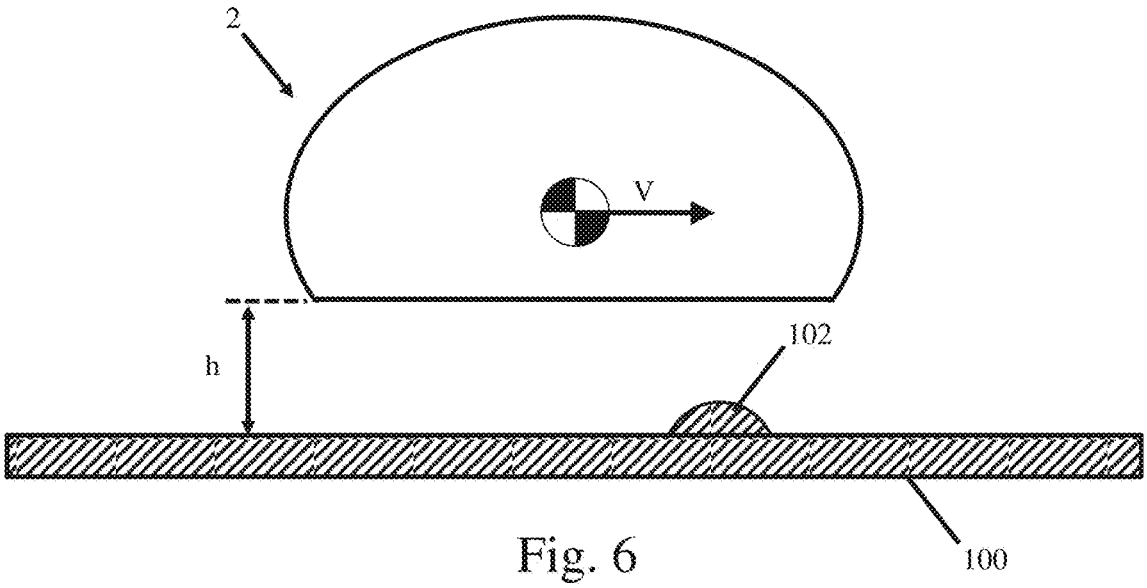
FIG. 6 is a schematic representation of an ellipsoidal vehicle traversing a surface with one or more irregularities.
Figure 7:
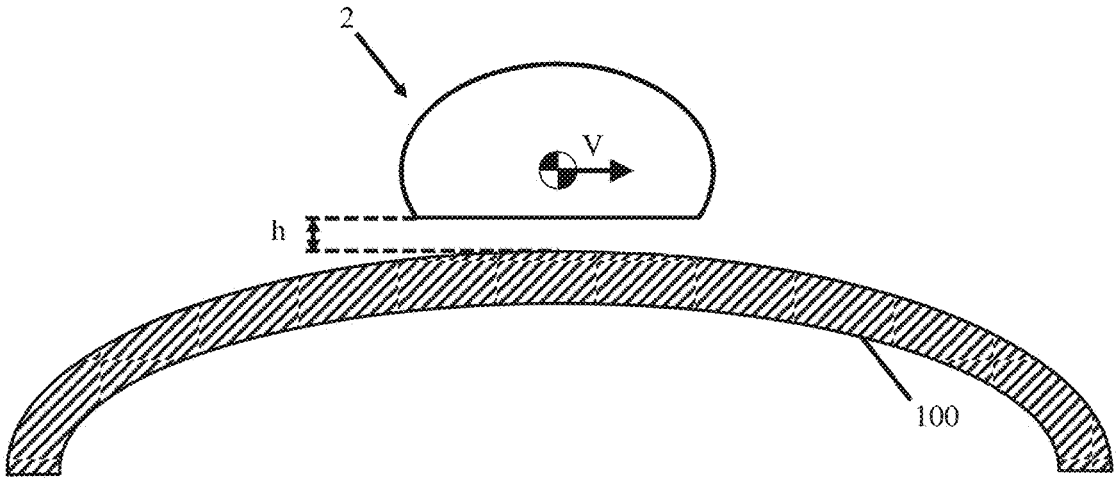
FIG. 7 is a schematic representation of an ellipsoidal vehicle traversing a curved surface.

FIGS. 6 and 7 illustrate a vehicle 2 traversing a surface in a lateral direction that is about parallel to an opposing portion of the surface 100 located beneath the vehicle. The vehicle is traversed across the surface at some desirable velocity V. As depicted in the figures, a surface may include any number of irregularities 102 such as bumps, objects, weld seams, and other possible features associated with that particular surface. Alternatively, the surface the vehicle is laterally traversing may be curved, such as might be expected for a ship hull, as shown in FIG. 7. In such an embodiment, the vehicle may be considered to be moving laterally, i.e. approximately parallel, to the curved portion of the hull opposite the vehicle and may continue in a nonlinear path following the curvature of the surface it is traversing. In either case, these variations in the surface's location, and/or irregularities located on the surface, affect a distance h between a bottom surface of the vehicle and the surface of interest the vehicle is laterally traversing. Further, in some applications such as when sensors are used for sensing information relative to the surface, it may be desirable to control this distance between the vehicle's bottom surface and the surface being inspected when these changes in surface location and/or irregularities are encountered to ensure the sensors are able to appropriately sense information from the surface. Various strategies and vehicle configurations for controlling this distance are detailed further below.

In the embodiments depicted in FIGS. 6 and 7, the vehicles 2 do not include tethers which may help to reduce the chance of snagging the vehicle in a cluttered environment such as those often encountered during an inspection. Additionally, the lack of a tether may also result in easier maneuvering of the vehicle and faster scan rates of the vehicle relative to a rough or irregular surface as compared to prior tethered vehicles that are in contact with the inspection surface. However, embodiments in which a tethered vehicle is used are also contemplated.

As noted previously, the lateral movement of a vehicle relative to a surface is one possible method for generating ground forces. Further, the balance of ground forces applied to the vehicle is related to the distance h between the vehicle and the ground. For example, and without wishing to be bound by theory, fluid forces on the vehicle due to the presence of a surface depends on the characteristic gap ratio, $\varepsilon=h/c$, where h is the distance of the vehicle bottom surface from the surface of interest. C is the chord length of the body. Typically, ε values equal to about 0.1 result in suction (Venturi) forces which are often times used in race cars to increase the experienced downwards force. However, for ε values less than 0.08 it was found that the boundary layers merge and instead a lift force occurs providing what is known as the wing in ground effect which is used in some vehicles to increase the experienced lift. However, for self-stabilization, instead of a constant down or up (WIG) force, in some embodiments, the aim is to create a net zero force region with a gradient that biases the vehicle back towards a desired position relative to a surface.

FIGS. 8A-9B illustrate a simplified two dimensional model of a partial ellipsoidal vehicle 2 with a flat bottom portion of the hull 6 travelling at a velocity U laterally relative to a surface. As noted above, depending on the height of the vehicle relative to the surface 100 different flow regimes are encountered. For example, and without wishing to be bound by theory, for a region extremely close to the surface, the vehicle experiences large viscous effects and flow in this region is most effectively understood through the interaction of the boundary layers. For a region close to the surface but greater than the boundary layer thickness, there is a flow channel between the body and the surface. Flow in this region is governed by a combination of Bernoulli's effect and Couette Flow. Therefore, increased velocity in this channel leads to a lower pressure (i.e. suction) which is called the Venturi Effect. Additionally, for a region further from the surface, where the effect of the ground becomes less pronounced, the flow transitions into the unbounded medium where the ground effect forces are negligible if present at all. These various regions and the resulting forces are described further below. It should be understood that while the regions are being described as discrete from one another, the various suction and lift forces are present in each region to varying amounts and it is more a question of which type of force dominates in that particular region and to what extent that force dominates the observed vehicle behavior.

Figure 8A:
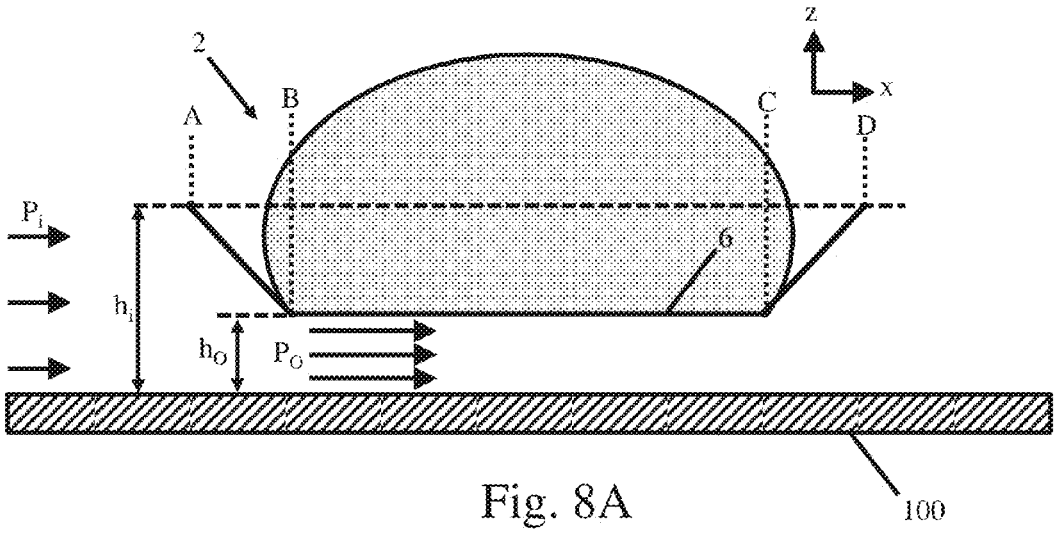
FIG. 8A is a schematic representation of a vehicle moving laterally relative to a surface in a region where an upwards ground effect force is present.
Figure 8B:
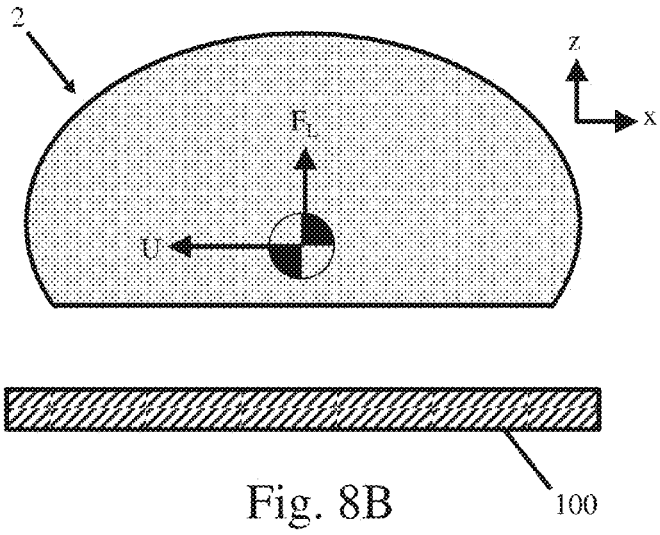
FIG. 8B is a schematic representation of the forces acting on the vehicle in FIG. 8A.
Figure 9A:
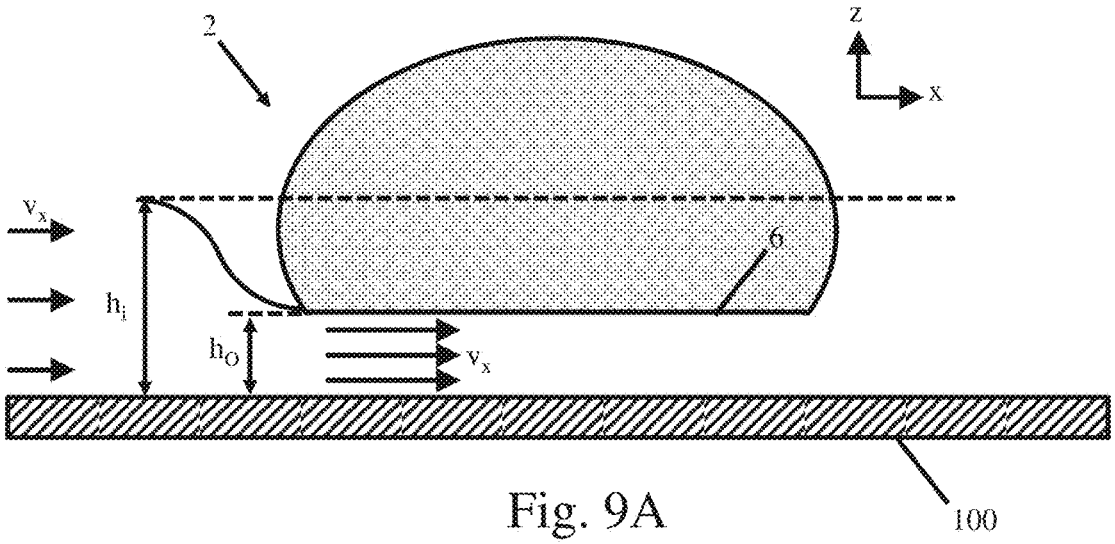
FIG. 9A is a schematic representation of a vehicle moving laterally relative to a surface in a region where a downwards suction ground effect force is present.
Figure 9B:
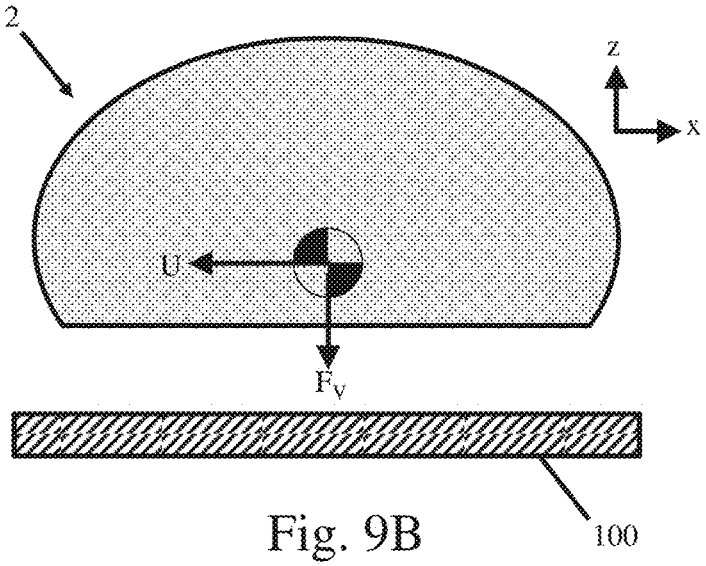
FIG. 9B is a schematic representation of the forces acting on the vehicle in FIG. 9A.

When a vehicle body is extremely close to a surface, lift forces experienced can have explanation through many theories. For example, for gap sizes with ε equal to or less than 0.01 the well-known lubrication theory, which deals with interaction of boundary layers as two surfaces move in relative motion, can be used. Flow here is highly viscous and the reduced Reynold's number is given by $\varepsilon^2 Re$. For simplicity a small region just above the base of the vehicle, can be modeled as an inclined slider of variable height that is moved relative to a surface at a constant velocity U as schematically shown in FIGS. 9A and 9B. The fluid has a velocity of $v_x$ that changes with the z position relative to a bottom surface of the vehicle. The governing equations for determining the resulting fluid velocities and pressures are the 2D Navier-Stokes equations for incompressible flow and Reynold's equation for lubrication theory. Qualitatively, the fluid enters at an inlet pressure $P_i$ at point A with a height of $h_i$. The maximum pressure $P_o$ occurs at point $h_o$ at point B as the fluid flow passes through a wedge from A to B that represents an idealized shape that may cause the observed effect. However, it should be noted that the repulsion and/or lift observed by the vehicle also may be highly attributed to a choking effect observed within the gap. The pressure then undergoes a linear drop in pressure from point B to C which can be modeled as parallel plates with an expected linear drop in pressure between these points. The schematic model then passes through an expanding wedge section from C to D, another idealized geometry that may cause the observed behavior, thus returning the pressure to $P_i$. Since the pressure at any point of the body is at or above the ambient (i.e. inlet pressure), there is a net positive lift force $F_L$ that acts on the vehicle as shown in FIG. 8B. This phenomenon can also be understood as resulting from an interaction between the two boundary layers which may merge causing choking in the channel resulting in the observed lifting force. In addition to the increased lift force, the vehicle may also experience increased drag due to the viscous friction between the boundary layers moving against each other.

In the region above the combined thickness of the boundary layers, where the flow may be considered inviscid, but still at a small gap from the surface, flow can be modeled as a fluid entering an idealized geometry of a pipe with a narrowing neck to better understand the observed phenomenon, as shown in FIGS. 9A and 9B. The radius starts at h, and reduces to $h_o$, and then expands back to $h_i$, From Bernoulli's equation, this would cause a corresponding increase in velocity in the narrow section, leading to a reduced pressure, or a suction force $F_v$, which can be modeled using Bernoulli's equation. The boundary layers enhance this effect as the moving ground drags fluid into the gap (i.e. Couette flow).

The above noted lift force and suction (i.e. Venturi) force oppose one another and vary in strength as the gap is varied, with the lift force fading faster with increasing gap distance than the Venturi force. In between the smaller distances experiencing a net lift, and larger distances experiencing a net suction, there is a balance point where the forces in the vertical z direction acting on the vehicle are net zero. In other words, there is a point where $F_L$ is equal to Fv, assuming the vehicle is neutrally buoyant. For example, as described in more detail in the examples values of ε may be broken down into the following regions shown in FIGS. 20 and 21 using $\varepsilon=h/c$: region a corresponding to $\varepsilon\leq 0.01$ where a positive lift force from lateral movement of the vehicle occurs; region b corresponding to $0.01\leq\varepsilon\leq 0.3$ where a negative lift (i.e. suction) force occurs from lateral movement of the vehicle; between regions a and b where a net zero ground effect force occurs around $\varepsilon=0.01$; and region c corresponding to $\varepsilon\leq 0.3$ where the ground effect force is no longer pronounced. The overall magnitude of the ground effect force may also increase with increasing vehicle velocity. In addition to the above, a negative slope of the lift force versus gap distance may be present for various values of ε. Further, it should be understood that any number of different ratios may be capable of providing a negative slope due to lateral movement of the vehicle relative to the surface due to effects from changes in size, shape, velocity, and flow regime to name a few. As noted previously, this response in the force versus gap distance may be utilized to create one or more stable equilibrium positions of a vehicle relative to a surface. Of course vehicles operating at stable equilibrium points outside of the noted c ranges due to the use of other types of ground effect forces are also contemplated as the current disclosure is not so limited.

In view of the above, a vehicle may be operated at a distance relative to a surface for generating ground forces due to lateral movement of the vehicle relative to the surface with any number of different values for ε. However, in one embodiment, the vehicle may be operated at a value of ε that is less than or equal to about 0.3, 0.1, 0.05, 0.01, or any other appropriate value. Correspondingly, the vehicle may be operated at a value of ε that is greater than or equal to about 0.001, 0.005, 0.01, 0.05, or any other appropriate value. Combinations of the above are contemplated including, but not limited to, between or equal to about 0.001 and 0.3. Of course operation of a vehicle in different ranges both greater than and smaller than those noted above is contemplated, especially when using vehicles of different size, operating at different velocities, and/or using different forms of ground effect forces.

Without wishing to be bound by theory, a magnitude of the ground effect forces generated using lateral movement of a vehicle relative to a surface increases with increasing vehicle velocity. Therefore, increasing a vehicle's velocity would increase the applied lift and/or suction forces applied to the vehicle. Thus a vehicle's speed may be controlled to either balance one or more other forces acting on the vehicle, or the speed may be controlled to bias the vehicle in a desired direction towards or away from the surface creating the noted ground effect forces. In addition to the above, if the vehicle is located in a region where the change in ground effect force relative to gap distance is negative, altering the velocity of the vehicle may also change the stable equilibrium position of the vehicle relative to the surface from a first position to a second position.

In one embodiment, the above noted control parameters for a vehicle may be combined with a vehicle including a surface, such as a flat hull portion. Additionally, this surface may include one or more sensors with a desired sensing range as noted previously. The flat hull portion may have an appropriate chord length, and a sufficient amount of thrust, in a desired scanning or movement direction to create at least one stable equilibrium ground effect height within a desired sensing range of the sensors as the vehicle is moved laterally relative to the surface. Of course embodiments where the chord length and thrust capacity are selected to provide a stable equilibrium position at other desired positions relative to a surface are also contemplated.

In another embodiment, a method of controlling the positioning of a vehicle using ground effect forces includes creating ground effect forces on the vehicle with one or more jets oriented towards a surface of interest the vehicle is located proximate to. As detailed further below, and without wishing to be bound by theory, the ground effect forces associated with one or more jets impinging on a surface are a combination of traditional lubrication theory at small gaps. However, as a distance to the ground is increased, ground induced lift loses (i.e. suction) begin to dominate which pulls the vehicle back towards a smaller gap. Thus, there is a stable equilibrium point with regards to the jet at small to intermediate distances. As the gap is increased further, lift enhancement from up wash pushes the vehicle away until the thrust applied to the vehicle is equal to that in free stream which may also be taken advantage of to create another stable equilibrium point for the vehicle relative to the ground. These individual phenomenon are described further below in reference to the figures.

Figure 10A:
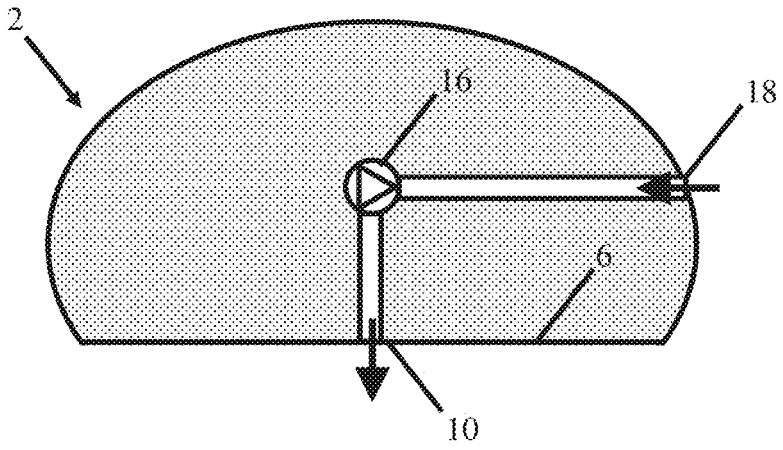
FIG. 10A is a schematic representation of a vehicle including a central thruster in a free stream condition.
Figure 10B:
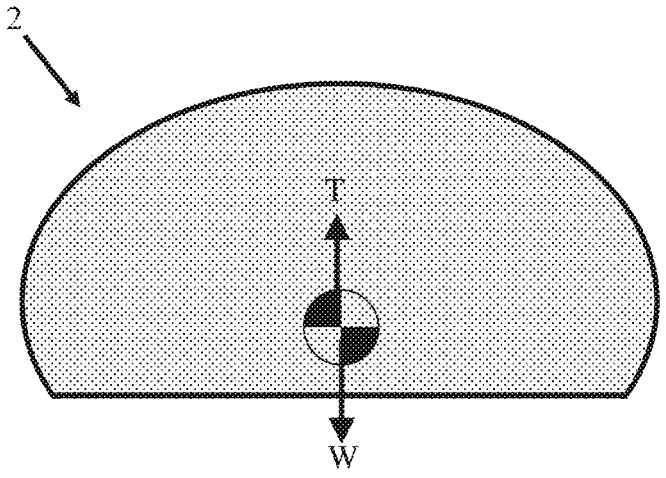
FIG. 10B is a schematic representation of the forces acting on the vehicle in FIG. 10A.

FIG. 10A illustrates one embodiment of a vehicle 2 including an inlet 18 in fluid communication with a pressure source 16, such as a centrifugal or other appropriate type of pump or turbine. The pressure sources include communication with a central thruster 10, which in some embodiments, located in the center of a flat portion of the vehicle's hull. In particular, the thruster is oriented perpendicularly downwards relative to the flat hull portion. Resulting in an upwards thrust T being applied to the vehicle in addition to the net weight of the vehicle W (actual weight minus buoyancy). The vehicle is depicted as being removed from any associated surfaces and therefore does not include any ground effects acting on it.

Figure 11A:
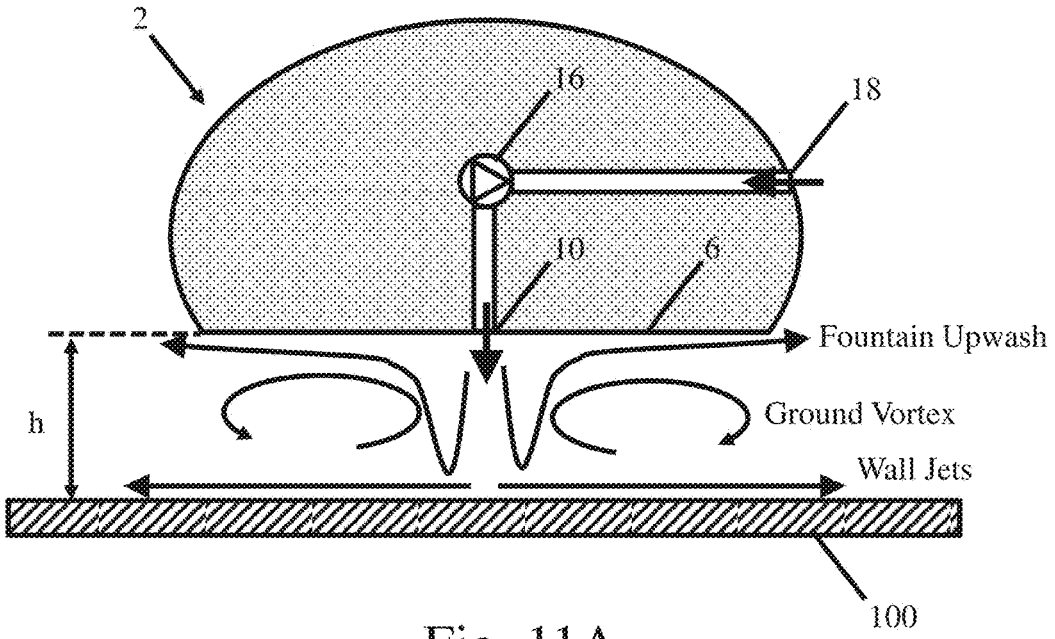
FIG. 11A is a schematic representation of a vehicle including a central thruster within a distance of a surface where ground effect forces are present.

FIG. 11A illustrates a vehicle located within a distance h of a surface. Depending on the particular distance and sizing of the thruster 10, different types of ground effect forces may dominate at different spacings. As shown in the figure, the jet flow from thruster 10 towards the surface 100 creates three different regions of interest which are dominated by three different kinds of fluid flows. Two parameters that help to characterize which particular type of fluid flow and resulting ground effect forces dominate include the characteristic gap length $\varepsilon=h/c$, where h is the gap height and c is the characteristic body length, or chord length of the associated surface, as detailed above for lateral movement. The other parameter is the ratio of the distance to the ground h to the thruster diameter d which is given by $\eta=h/d$. The different regions of interest shown in the figures are described further below.

Initially, in a first region, when a vehicle's bottom surface, such as the flat bottom hull portion 6, is in contact with the surface 100 and the thruster 10 is turned on. When in contact, the flow wants to come out but cannot due to the surface obstructing flow from the thruster. At a particular pressure for a given opening size, the pressure creates the a lift force Lf that is large enough to raise the body by a minimal distance sufficient to release the pressure, see region 1 in FIG. 31. A thin film is then created underneath the vehicle. This is somewhat similar to air bearing sliders or radial flow through parallel disks where the body stays at a stable equilibrium distance relative to the surface on a thin film of low velocity fluid having a thickness that is between or equal to 0.5 mm and 4 mm, 1 mm and 2 mm, or any other appropriate fluid film thickness. Further, fluid films having thicknesses both greater than and smaller than those noted above are also contemplated depending on thruster strength and sizing as well as vehicle size. This phenomenon is commonly called lubrication theory for fluid film formation, and without wishing to be bound by theory, this explanation is valid as long as the flow can be approximated as a low Reynold's number laminar flow where inertial forces are smaller than viscous stresses.

Figure 31:
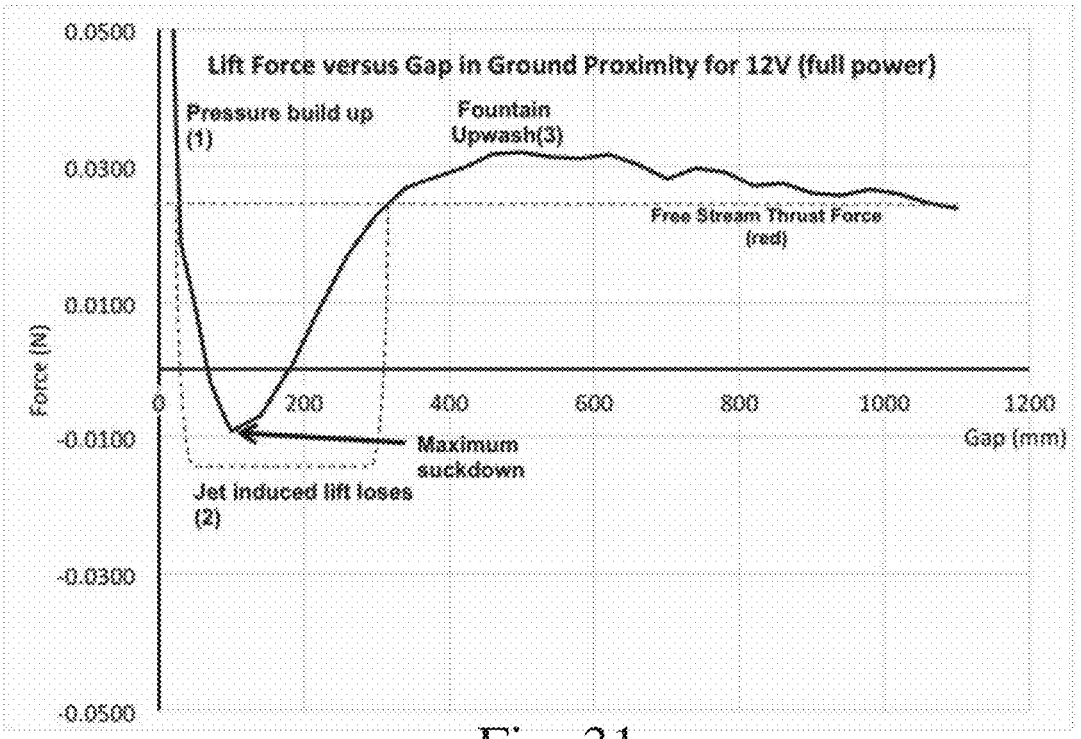
FIG. 31 is a graph of the force applied by a thruster to a vehicle at different gap values relative to a surface.

As the gap distance h is increased to a second region, see region 2 in FIG. 31, the vehicle experiences a steep loss in the lift force, i.e. a change in the lift force with increasing gap distance is negative. Without wishing to be bounded by theory, this is due to the jet from thruster 10 impinging on the surface 100, along with the wall jets that flow parallel to the surface and radiate out, creating a low pressure region under the vehicle. This low pressure region results in a strong suction force $L_S$. This suction effect depends on the ratio of the proximity to the ground and the nozzle diameter $\eta=h/d$ as well as the nozzle pressure ratio (NPR) which is the ratio between the jet stagnation pressure and the ambient pressure. Therefore, while at close proximity to a surface it might be expected that the presence of the ground would provide additional lift, at small distances greater than the fluid film distance, strong suck down forces or negative pressure regions may be experienced. For instance for $\eta \leq 0.3$ it is seen that the flow radiating out from the vehicle remains attached to the body at the leading edge leading to small ground vortices within the gap which generate negative pressures that decrease with the increasing height. The suck down force at $\eta \geq 0.3$ can also be understood from the fact that a primary jet along with the wall jets entrain fluid beneath the vehicle body thereby accelerating the water beneath the vehicle creating a negative pressure difference between the vehicle's upper and lower sides which causes a low pressure zone under the vehicle and corresponding steep reduction in lift. However, as the height is increased relative to the ground, the vortex disappears and the pressure differential goes to zero. Region In addition to $\eta$ and NPR noted above, other parameters that are said to affect the induced lift (positive or negative) are the jet structure as well as jet impingement angle to the ground.

For larger gap distances h corresponding to a third region, the suck down forces are reduced, and fountain up wash from the jet impinging on the surface begins to dominate the ground forces, see region 3 in FIG. 31. Specifically, the jet impinging on the surface is reflected upwards off the ground towards the vehicle bottom surface. This effect, generally termed a fountain effect, produces a positive pressure on the undersurface of the vehicle that increases the lift force $L_f$ acting on the bottom portion of the vehicle's hull oriented towards the surface. However, the fountain effect is suppressed relatively quickly as the vehicle is brought into closer proximity to the ground due to the strong suction forces. Additionally, the fountain effect eventually decays to zero as the gap is increased resulting in the free stream thrust being applied to the vehicle at larger gap distances. It should be noted that the fountain effect is observed for both single, and multiple, jets impinging on a surface. Additionally, it should be noted that the fountain effect may not overcome the suck down forces for lower velocity jets as illustrated in the examples below. Therefore, the presence of a positive lifting force in this third region may be contingent on the thruster having sufficient thrust capacity to create a large enough fountain effect to overcome the associated suck down effects that dominate the ground effect forces in region 2.

In view of the above, in one embodiment, region 1 corresponding to pressure build up and a thin fluid film may exhibit $\eta$ between or equal to 0.08 and 0.6; region 2 corresponding to suck down may exhibit $\eta$ between or equal to 0.6 and 64; and region 3 corresponding to fountain up wash may exhibit $\eta$ between or equal to 64 and 200. Of course it is expected that region 3 might extend down to $\eta$ greater than or equal to 32 in some cases. Corresponding stable equilibrium points were observed at approximately 1 mm, 100 mm, and 500 mm. Again, it should be understood that the values determined above were for a particular vehicle and that values both greater than and less than those noted above for each region may also occur due to the $\eta$ values associated with these regions changing for different vehicle sizes, thruster velocities, design and operating parameters.

Figure 11B:
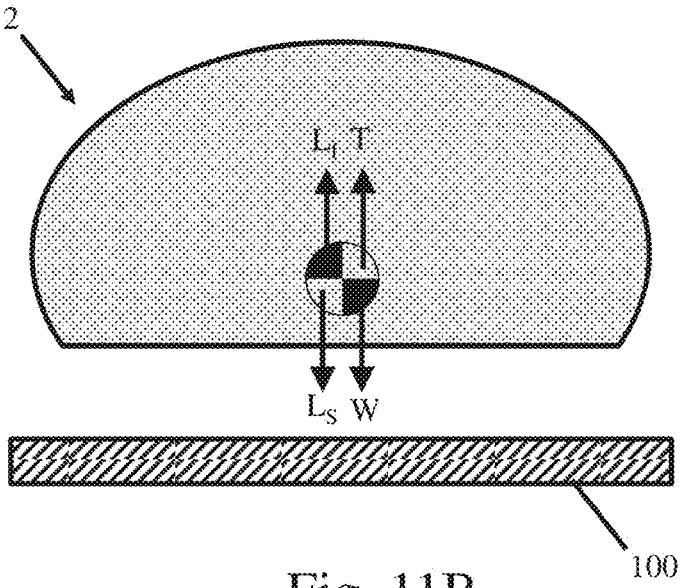
FIG. 11B is a schematic representation of the forces acting on the vehicle in FIG. 11A.

FIG. 11B shows the various forces acting on the vehicle when a jet is oriented towards an adjacent surface. As shown in the figure, the vehicle includes a net weight W (actual weight minus buoyancy), a suction force $L_s$ acting downwards on the vehicle towards the surface, a thrust T oriented upwards relative to the flat bottom hull portion 6, and a lift force $L_f$ from the noted fountain effect. As also seen in FIG. 31*a* slope of a combined force including thrust and the ground effect forces applied to a vehicle versus gap size, i.e. distance from a corresponding surface, has a negative change in force versus gap distance at two locations indicating that there are two stable equilibrium positions for the vehicle relative to the surface. First, for small gaps (i.e. small $\eta$), the suck down and net weight of the vehicle may be balanced against the vehicle's thrust and lift to maintain the vehicle in the equilibrium position. At the second stable equilibrium position, which is on the order of the size of the vehicle or larger, the net weight of the vehicle is balanced against the thrust plus the fountain up wash and minus a weakened suck down force. Similar to the above, in both stable equilibrium positions an upward perturbation of the gap distance decreases the lift force $L_f$ contribution, while a downward perturbation of the gap distance increases the lift force $L_f$. Thus, the ground forces alter with changing distance to automatically bias the vehicle towards the desired equilibrium position. However, the specific distance at which this condition occurs is dependent on the thruster, or jet, velocity. Thus, the thruster velocity may be increased or decreased to correspondingly increase or decrease the gap distance of each second stable equilibrium position. It is noted though, that the second equilibrium position located at larger gap sizes (i.e. larger $\eta$) has a smaller slope, and therefore allows for a greater variation in equilibrium position than the equilibrium position located closer to the surface. Additionally, for sufficiently low velocities the second stable condition may disappear due to the fountain effect being overcome by the suction effects.

In addition to the interactions of a thruster diameter, as noted previously, in some embodiments, the ratio $\varepsilon=h/c$ may also influence the equilibrium distances experienced by a vehicle. For example, while stable equilibrium distances may change based on speed, thrust, vehicle size, and shape to name a few, these ground effect forces may result in a lower stable equilibrium positions with $\varepsilon$ values corresponding to between about 0.5-1.5 body lengths and higher stable equilibrium positions with $\varepsilon$ values corresponding to between about 4-10 body lengths from a surface. However, again, due to changes in a vehicle's design and/or operation, different values for these ranges, both larger and smaller, are also contemplated.

While two separate methods for creating and controlling various types of ground effect forces have been described above, it should be understood that these methods may either be used separately or in combination as the disclosure is not so limited. For example, one or more stable equilibrium positions for a vehicle relative to a surface may be created by balancing the net weight of a vehicle immersed within a fluid with a net thrust applied to the vehicle away from the surface (may be positive or negative depending on the thrust directions and/or magnitudes) as well as ground effect forces resulting from the lateral movement of the vehicle relative to the surface and/or one or more thrusters oriented towards the surface generating suck down and/or fountain up wash.

Additionally, the velocity of the vehicle relative to the surface, a magnitude of the thrust, and/or a buoyancy of the vehicle may be altered in order to alter the resulting stable equilibrium positions of the vehicle.

Figure 12A:
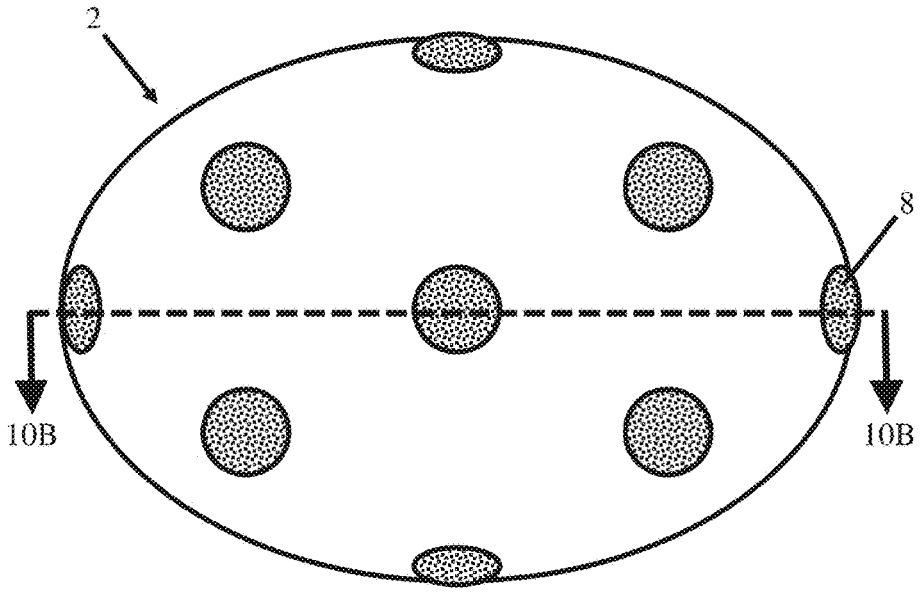
FIG. 12A is a top view of one embodiment of a vehicle including a pump and multiple thrusters oriented in different directions.
Figure 12B:
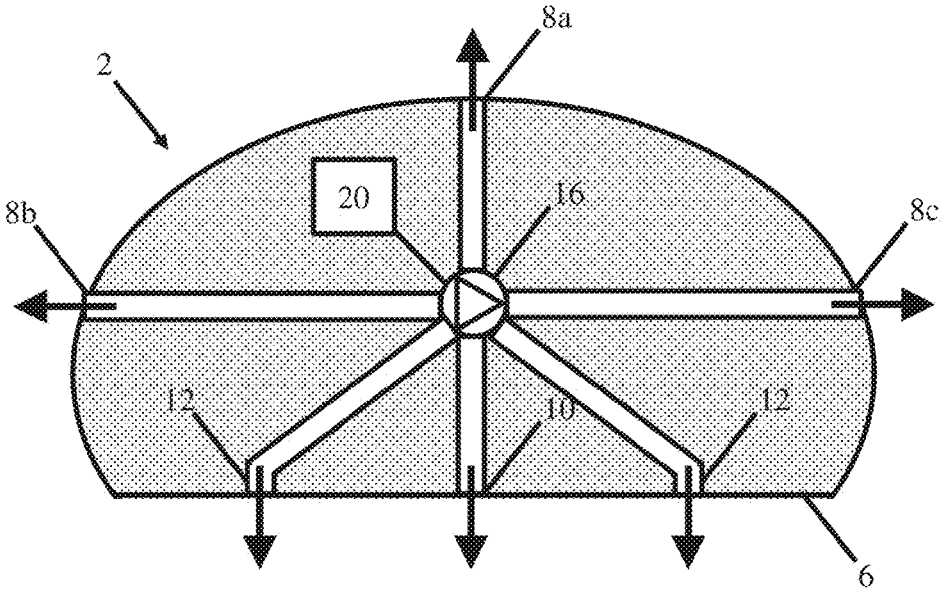
FIG. 12B is a cross sectional side view of the vehicle of FIG. 12A illustrating the arrangement and orientation of thrusters along different portions of the vehicle.

In view of the above, various embodiments of a vehicle may include thrusters in any number of locations and oriented in a variety of directions. For example, FIGS. 12A and 12B illustrate one embodiment of a vehicle that includes a thruster oriented upwards away from a flat bottom portion 6 of the hull. The vehicle also includes one or more laterally oriented thrusters 8*b* and 8*c* which apply thrusts to the vehicle in directions that are parallel to the flat bottom portion of the hull, though angled lateral thrusts may also be applied. A central thruster 10 and two thrusters 12 located on opposing sides of the central thruster are oriented perpendicularly down relative to the flat bottom portion of the hull. Pressures are applied to these thrusters using an appropriate pressure source 16 fluidly connected to an inlet, not depicted. The pressure source is in electrical communication with a controller 20 that controls the operation of the pressure source and various associated thrusters.

Figure 13A:
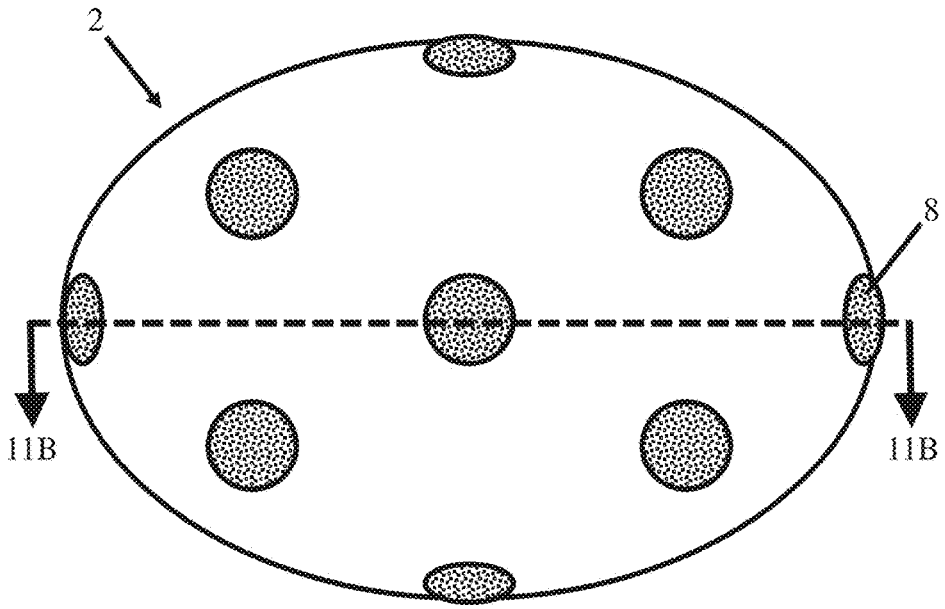
FIG. 13A is a top view of one embodiment of a vehicle including a pump and multiple thrusters oriented in different directions.
Figure 13B:
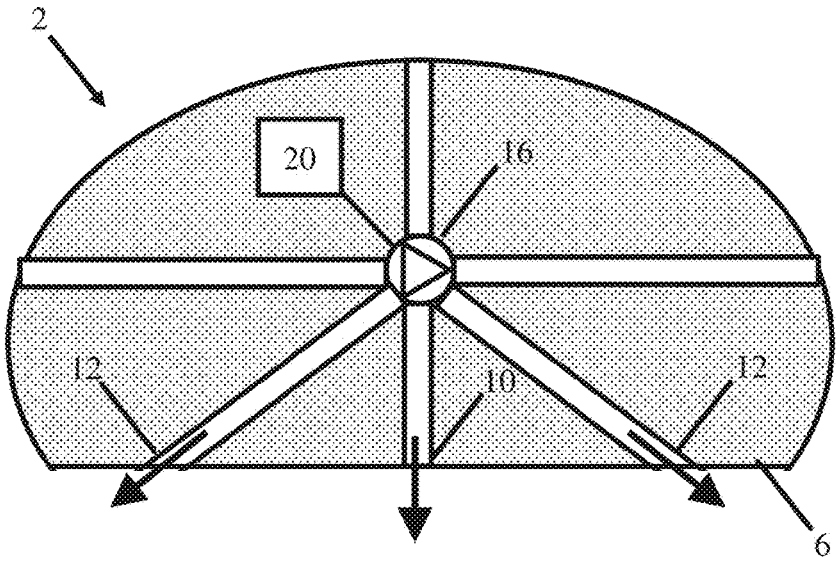
FIG. 13B is a cross sectional side view of the vehicle of FIG. 13A illustrating the arrangement and orientation of thrusters along different portions of the vehicle.
Figure 14A:
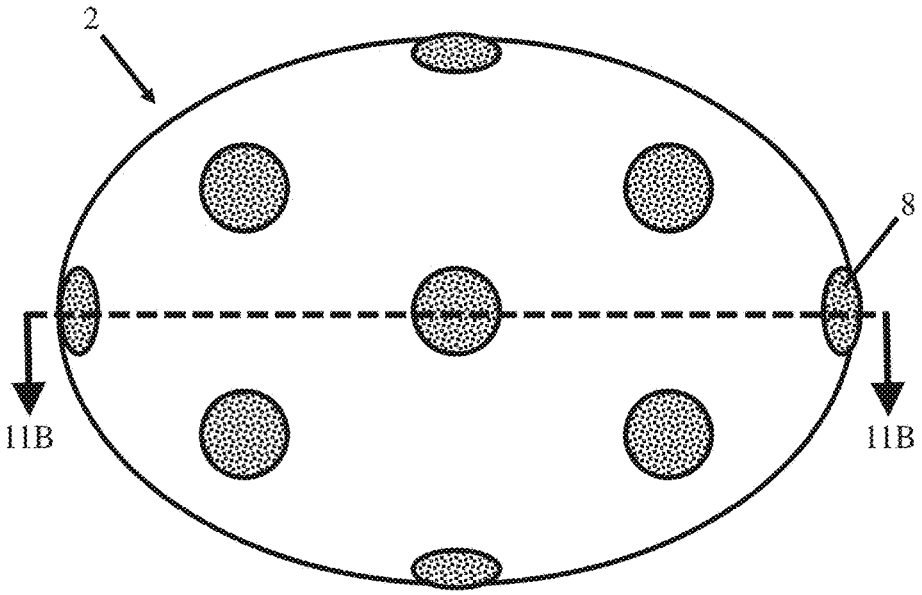
FIG. 14A is a top view of one embodiment of a vehicle including a pump and multiple thrusters oriented in different directions.
Figure 14B:
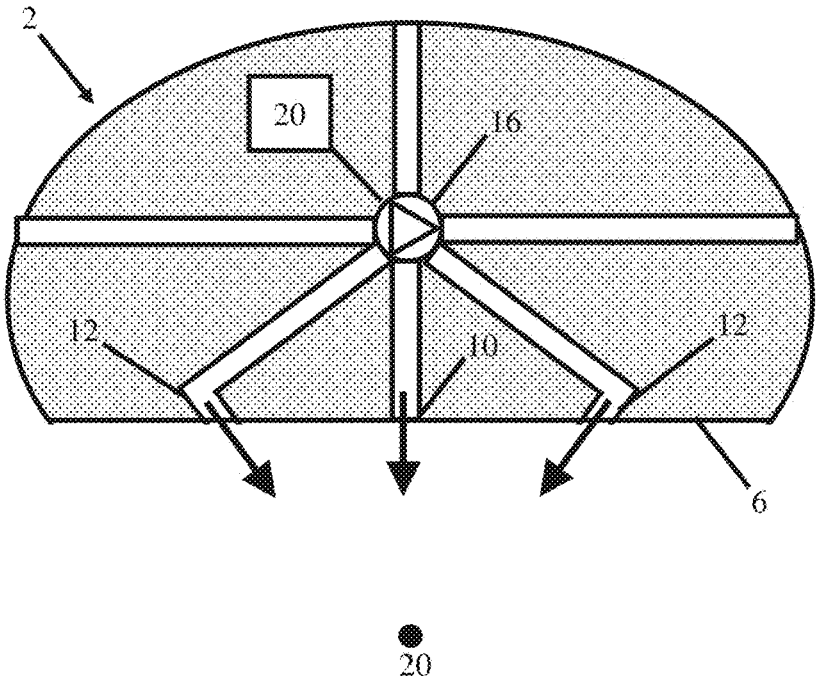
FIG. 14B is a cross sectional side view of the vehicle of FIG. 14A illustrating the arrangement and orientation of thrusters along different portions of the vehicle.
Figure 15:
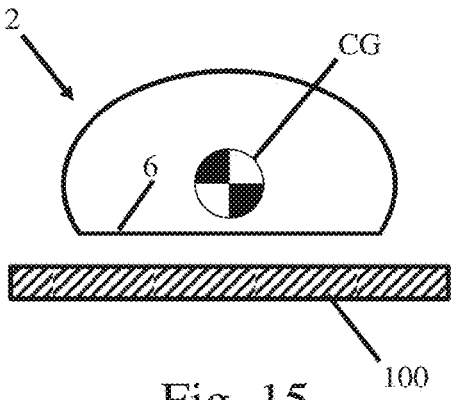
FIG. 15-FIG. 18 are schematic representations of a vehicle including a variable center of gravity used to orient a flat portion of the vehicle towards surfaces oriented at different angles.
Figure 16:
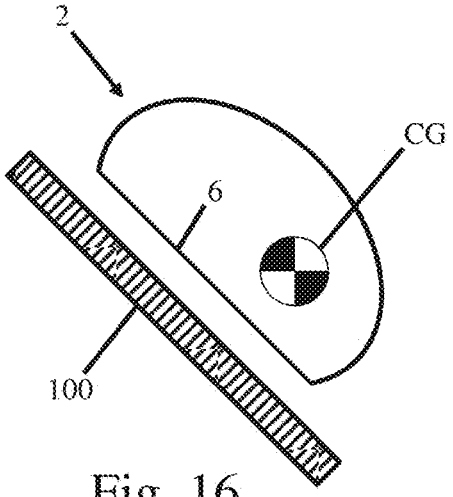
Figure 17:
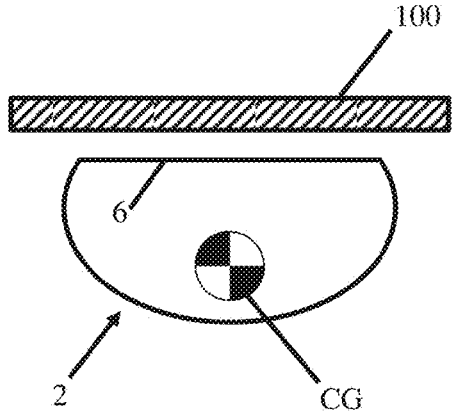
Figure 18:
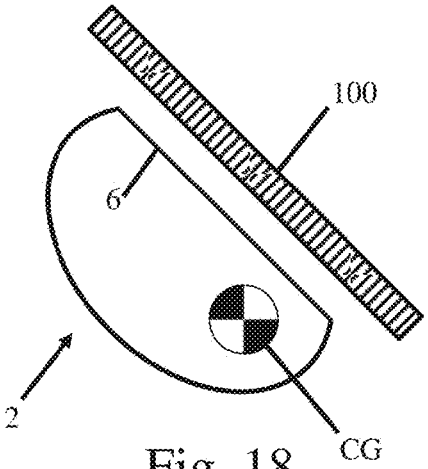

FIGS. 13A and 13B illustrate an alternative embodiment of a vehicle 2 including thrusters located on the flat bottom portion 6 of the hull that are located radially outwards relative to the central thruster 10. In this embodiment, the thrusters surrounding the central thruster are angled down and laterally outwards away from an axis passing perpendicularly through a center of the flat bottom portion of the hull. Such a configuration may help with the lateral stability of the vehicle relative to a surface. In yet another alternative embodiment, see FIGS. 14A and 14B, the thrusters located on the flat bottom portion of the hull and radially outwards from the central thruster 10 are angled down and inwards towards the axis passing perpendicularly through a center of the flat bottom portion of the hull to enhance a fountain effect resulting from the thrusters impinging on a surface. In some embodiments, one or more, and in some instances all, of the thrusters oriented down and laterally inwards, on the flat portion of the hull are directed towards a point 20.

While a simple pump connected to the various thrusters has been illustrated in the figures above, it should be understood that the pressure source 16 may correspond to any appropriate combination of pumps, turbines, propellers, accumulators, valves, distribution manifolds and/or other appropriate hydraulic components as the disclosure is not limited in this manner.

As illustrated in FIGS. 15-18, sometimes a surface 100 that a vehicle 2 is located adjacent to is arranged in an orientation other than vertically upwards, as might occur during any number of inspection processes. For example, in addition to be oriented vertically upwards, as might be expected for a seabed, a surface may be oriented vertically downwards, as might be expected for the bottom of a ship hull and/or any angle between. Thus, in some embodiments, a vehicle including a flat bottom portion of the hull may be capable of being oriented in any desired orientation in order to align the flat portion of the hull 6 with the corresponding surface of interest. The ability to orient the vehicle may be accomplished in any appropriate manner. However, in one embodiment, the vehicle is oriented by adjusting the position of the center of gravity of the vehicle. This variable center of gravity may be provided in any number of ways including, but not limited to, a displaceable weight, or ballast, located within the vehicle interior. Alternatively, a center of buoyancy within the vehicle may by altered to control an orientation of the vehicle. This may be accomplished in any appropriate fashion including, but not limited to, the use of one or more selectively inflatable bladders located in various positions within a flooded vehicle interior or selectively floodable compartments.

In the above embodiment, a vehicle may be first oriented towards a surface of interest. Then, if it is desired to maintain a position of the vehicle relative to the surface in that orientation, the vehicle is either moved laterally relative to the surface and/or a thrust is directed towards the surface while a corresponding thrust is applied to the vehicle to bias the vehicle towards the surface of interest. Correspondingly, a substantially net zero force may be applied to the vehicle in a direction oriented towards the surface to create a stable equilibrium position at the desired location. For example, the sum of the vehicle net weight, thrust both towards and away from the surface, and the corresponding ground effects may be balanced in a direction oriented towards the surface. Of course, the ground effect force applied to the vehicle includes components from moving the vehicle laterally relative to the surface and/or applying a thrust oriented towards the surface. Additionally, the change in the resulting force aligned with the surface with increasing gap size may be negative to ensure that the vehicle is biased towards the desired position when the distance is altered. However, modes of operation where the change in force versus gap size is positive are also contemplated.

Figure 19:
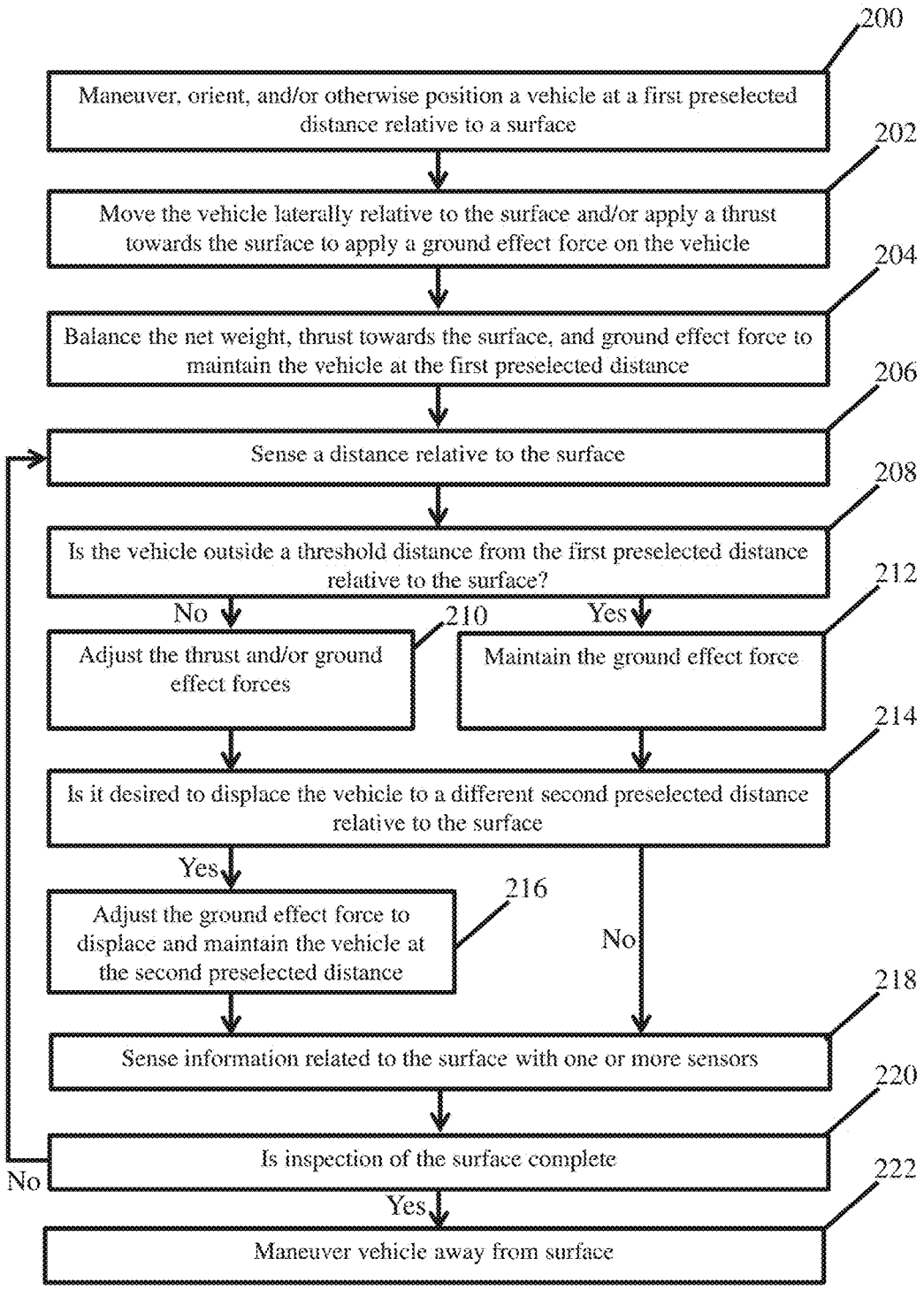
FIG. 19 is a flow diagram of one possible embodiment of a control method for a vehicle using ground effect forces to maintain a desired distance relative to a surface.

Having described various control methods and vehicle configurations, one embodiment of a method for controlling a vehicle relative to a surface is described in relation to FIG. 19. In the figure, a vehicle is maneuvered, oriented, and/or otherwise positioned at a first preselected distance relative to a surface at 200. The vehicle is then moved laterally relative to the surface and/or a thrust is applied towards the surface to generate one or more ground effect forces that subsequently affect the dynamics of the vehicle at 202. At 204, the vehicle net weight (i.e. vehicle weight minus buoyancy) is balanced with thrusts applied to the vehicle that are oriented towards and/or away from the surface along with the resulting ground effect forces. As noted previously, the distance at which a net zero force applied to the vehicle oriented towards the surface occurs may be a stable equilibrium point. Further, in some embodiments, the preselected distance relative to the surface corresponds to a stable equilibrium position, which as noted above, may be controlled by the vehicle shape, lateral velocity of the vehicle relative to the surface, thruster diameter, and a magnitude of the jet impinging on the surface from the thruster oriented towards the surface.

Once appropriately positioned relative to a surface, a control loop is implemented. At 206, one more sensors sense the distance between a bottom surface of the vehicle and the surface being inspected. If the vehicle is within a threshold distance from the first preselected distance relative to the surface, the various parameters related to the ground effect force are maintained at 208 and 212 which provide an automatic control of the vehicle about the stable equilibrium position using the existing hydrodynamic forces. However, if the vehicle is outside the desired threshold distance from the preselected distance relative to the surface, the thrust applied to the vehicle relative to the surface and/or one or more parameters controlling the ground effect forces, such as the lateral velocity and/or thrust magnitude oriented towards the surface, may be altered at 210. These altered forces then bias the vehicle towards the desired first preselected distance relative to the surface. An appropriate threshold distance will depend on the particular application. However, in some embodiments, an appropriate threshold distance may be based on an absolute distance threshold or a threshold based on the size of the vehicle and the application it is being applied to. For example, a threshold may be selected to maintain a sensor within a desired sensing range.

In some instances, it may be desirable to displace a vehicle to a different second preselected distance relative to a surface as might be the case when using different sensors with different desired sensing range, 214. If such an adjustment is desired, the thrust applied to the vehicle relative to the surface and/or the related ground effect forces may be controlled to move the vehicle to the second preselected distance at 216 which again may also correspond to a stable equilibrium position, though, instances where this second position is simply controlled using a feedback loop are also contemplated. For example, in one embodiment, it may be desirable to alter the applied thrust oriented towards a surface to move the vehicle from a stable equilibrium point closer to the surface which may be appropriate for a close range sensor towards a more distant stable equilibrium point that is more appropriate for a visual inspection of the surface using a camera or other longer range sensor. In either case, once the vehicle is within a desired sensing range, one or more sensors may sense information related to the surface at 218. If the inspection of the surface is not complete, the control loop is continued at 220. Alternatively, once the inspection is complete, the vehicle may be maneuvered away from the surface and controlled in any other appropriate manner, see 202.

In addition to altering the various thrusts and ground effect forces associated with a vehicle, in some embodiments, the net weight of the vehicle within a fluid may also be altered to aid in controlling the position of the vehicle. For example, the vehicle may have a variable buoyancy provided by one or more inflatable bladders, fillable chambers, and/or any other appropriate arrangement capable of varying a buoyancy of the vehicle within the fluid.

The above-described embodiments of various control methods and systems including controllers to implement those methods may be configured in any number of ways. For example, a controller may correspond to any appropriate computing device which may be configured as any suitable processor or collection of processors associated with memory, whether provided in a single computing device or distributed among multiple computing device. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format. Further, it should be appreciated that a computing device may be embodied in any of a number of forms, such as a computing device connected to a vehicle through a tether or wirelessly including, but not limited to, a rack-mounted computer, a desktop computer, a laptop computer, a tablet computer, a smart phone, a separate custom designed control device, or any other appropriate computing device. Additionally, a computing device may be directly integrated with a vehicle in which case the vehicle may be autonomous and/or may be configured to receive and execute commands received either wirelessly or through a tether.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the disclosed embodiments may be embodied as a computer readable storage medium (or multiple computer readable media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other tangible computer storage medium) encoded with one or more programs that, when executed on a vehicle implement the various methods and processes discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computers or other processors to implement various aspects of the present invention as discussed above. As used herein, the term "computer-readable storage medium" encompasses only a non-transitory computer-readable medium that can be considered to be a manufacture (i.e., article of manufacture) or a machine. Alternatively or additionally, the invention may be embodied as a computer readable medium other than a computer-readable storage medium, such as a propagating signal.

The terms "program" or "software" are used herein in a generic sense to refer to any type of computer code or set of computer-executable instructions that can be employed to program a computing device or other processor to implement various aspects of the present invention as discussed above. Additionally, it should be appreciated that according to one aspect of this embodiment, one or more computer programs that when executed perform the disclosed methods need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

The above described control methods and structures for a vehicle may be implemented in a number of different applications and environmental situations. For example, while the examples described below were conducted in idealized conditions and/or still water, the methods and vehicles described herein may be implemented in either quiescent conditions or turbulent conditions, as might be expected in the ocean, though the use of appropriate controls and/or feedback loops.

EXAMPLE

Simulations of Lateral Movement Induced Ground Effect Forces

To explore how fluid flow affects the vehicles described herein, flow around the vehicle was simulated using standard CFX, the standard static CFD software from ANSYS. For the simulated vehicle moving at 0.5 m/sec, the Reynolds number was approximately 40, 000, based on which the κε turbulent flow model was chosen. A fine (high density) mesh was used in the gap region between the vehicle and corresponding surface. The remainder of the volume was meshed using standard, default settings. Mesh quality was tested by increasing mesh density until doubling the density (node count) resulted in less than a 10% change in lift and drag forces. Buoyancy was not included.

A simulation conducted at 5 mm, confirmed the expected flow and pressure patterns associated with a vehicle traversing laterally over a surface. Specifically, the high velocity under the vehicle caused a drop in pressure. However, leakage of flow in the y direction caused the flow velocity magnitude to die away quickly before reaching the exit. This uneven flow and pressure distribution caused a higher pressure at the back than the front leading to a nose down pitching moment. However, zero pitch can be achieved through design of the underbody as well as through active control through the pressure jets.

Figure 20:
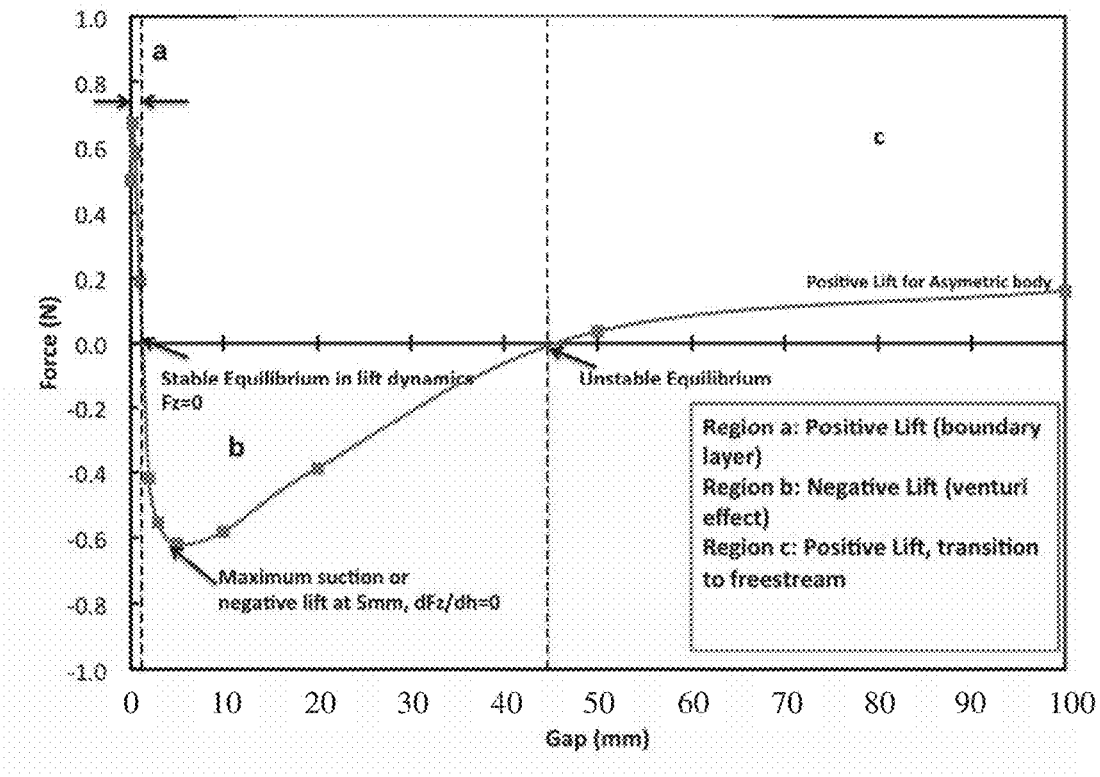
FIG. 20 is a graph of force versus gap size for a vehicle including an asymmetric body moved laterally relative to a surface.
Figure 21:
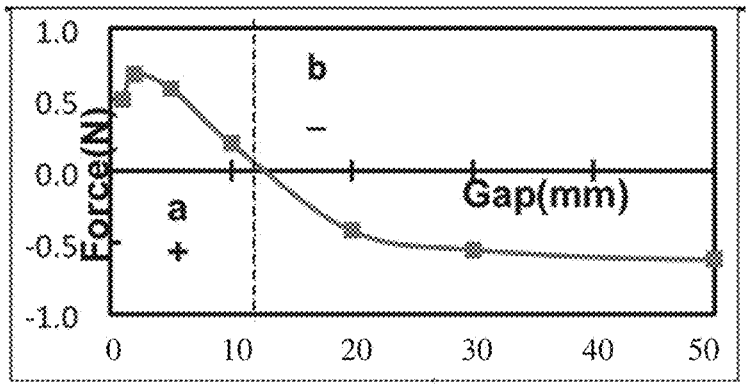
FIG. 21 is a graph of force versus gap size for a vehicle including an asymmetric body moved laterally relative to a surface at smaller gap sizes.

In addition to confirming the flow patterns and dynamics, the expected lift and suction forces were calculated. Referring to FIGS. 20 and 21, the simulation results identified three flow regimes using $\varepsilon=h/c$:

1) $\varepsilon \leq 0.01$ in region (a) with positive lift forces;

2) $0.01 \leq \varepsilon \leq 0.3$ in region (b) with negative lift forces; and 3) $\varepsilon \geq 0.3$ in region(c) where the ground effect forces are no longer pronounced.

FIGS. 20 and 21 shows the simulation results for the vehicle moving at a velocity of 0.5 m/sec at various gap lengths. Extremely close to the surface, below 2 mm (region a) there is a lift force acting on the vehicle. The vehicle stabilizes at 2 mm, where all the forces balance. Above 2 mm (region b) the Venturi force pulls the vehicle towards the ground, but there is a second equilibrium point around 50 mm. However, this is an unstable equilibrium point (i.e. positive slope). Therefore, if the vehicle is displaced away from the equilibrium point it will continue away from the equilibrium point due to the ground effect forces not biasing it back. Above 50 mm there is again a net lift force which extends out to large distances as the body smoothly transition to free stream behavior.

The transition from region (a) $Fz>0$ (lift) to region (b) $Fz<0$ (suction)—occurs near 2 mm where $Fz=0$. The negative slope at this point makes this a stable equilibrium position. Specifically, a positive z displacement results in $Fz<0$ while a negative displacement results in $Fz>0$. Thus, the vehicle is brought back to the $Fz=0$ point. In contrast, at the $Fz=0$ point around 50 mm, a positive z displacement results in a positive Fz, pushing the vehicle even further away, and correspondingly for negative z displacement results in a negative Fz which sucks the vehicle further down. The disappearance of the forces at 2 mm, combined with a large negative gradient (i.e. large restoring force) is particularly useful since this may allow the vehicle to be stabilized at a small gap using hydrodynamics alone.

Figure 22:
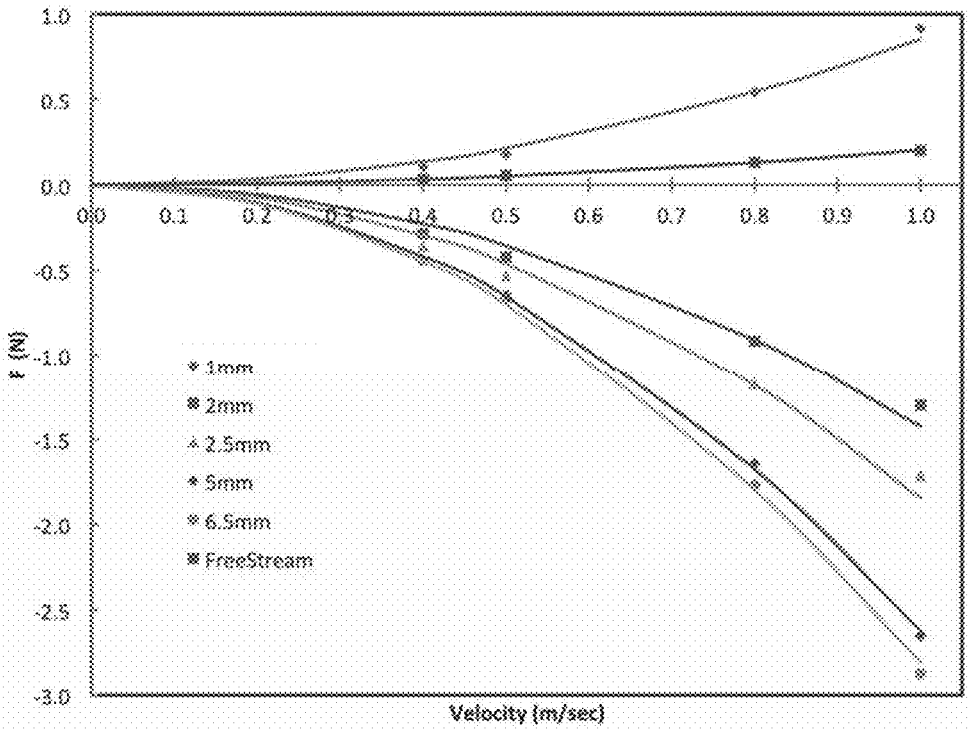
FIG. 22 is a graph of calculated lift force versus velocity for different gap sizes.

FIG. 22 shows the CFD simulations for runs at 1 mm, 1.5 mm, 2 mm, 2.5 mm, 5 mm and 6.5 mm at velocities ranging from 0.4 m/sec to 1 m/sec. The lift force is observed to follow $v^2$, as expected for turbulent flow. Drag forces (not shown) also vary as $v^2$. Velocity independent drag and lift coefficients were therefore used in place of forces vs velocity for modeling purposes.

EXAMPLE

Stability Analysis

Figure 24:
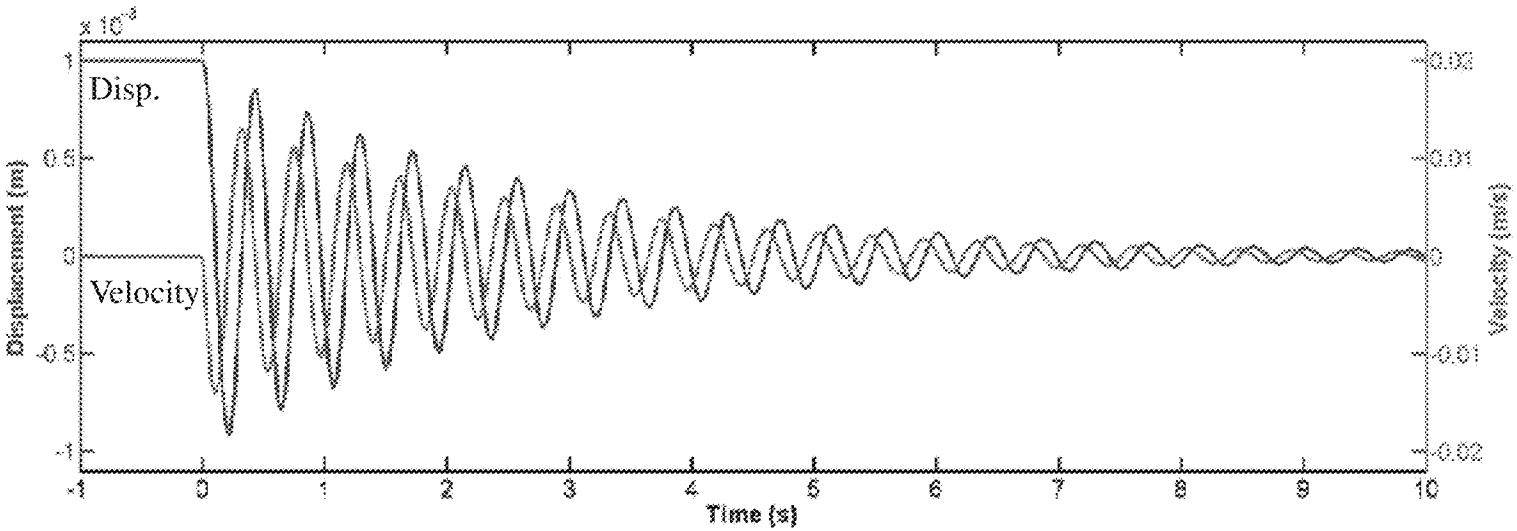
FIG. 24 is a graph of displacement and velocity of a vehicle around a stable equilibrium position relative to a surface when the vehicle is initially displaced by 1 mm.

Although a vehicle is stable at its equilibrium point, in some instances it is desirable to know the maximum perturbation in z that a vehicle can tolerate while self correcting. FIG. 24 presents a graph of calculated velocity and displacement for a vehicle with a mass m of 2.2 kg moving at 0.5 m/sec laterally relative to a surface. The restoring force used in the model was:

$$\frac{dF_z}{dh} = -220 \text{ N/m}$$

The system was modeled as a spring mass system with the spring constant k equal to the restoring force. Therefore, a resonant frequency was calculated as below.

$$\omega=\sqrt{k/m}=8.8 \text{ rad/sec} \leftrightarrow f=1.4 \text{ Hz}$$

The vehicle was then subjected to a 1 mm displacement from equilibrium. The figure shows the displacement and velocity ossilating around zero as they are slowly damped out and the vehicle is automatically returned to the equilibrium position.

If the vehicle is perturbed to have a velocity $v_z$ the imparted kinetic energy $\frac{1}{2} mv_z^2$ will cause the vehicle to move by a distance h' where the kinetic energy is equal to the stored potential energy $\frac{1}{2} kh'^2$. If the imparted kinetic energy is greater than the potential energy that can be stored without exceeding the gap distance, $$\frac{1}{2}mv_z^2 > \frac{1}{2}kh'^2$$

it may result in the vehicle contacting the surface unless an active thrust is applied to the vehicle. This may be concept may be used to determine when to actively control the vehicle when it is perturbed from a stable equilibrium position. For example, the above relationship may be rearranged to provide.

$$|v_z|>\omega h$$

Thus, if a natural frequency of the vehicle in a particular location relative to a surface multiplied by the gap distance is less than a magnitude of the vehicle's velocity relative to the surface, an active thrust may be applied to the vehicle to bias the vehicle back towards a desired position to couteract the velocity and avoid bottoming out. Alternatively, instead of a height, the relationship may be used to determine when to apply an active thrust to the vehicle to maintain the vehicle within a threshold distance of a desired location.

EXAMPLE

Size Effect Analysis

Figure 25:
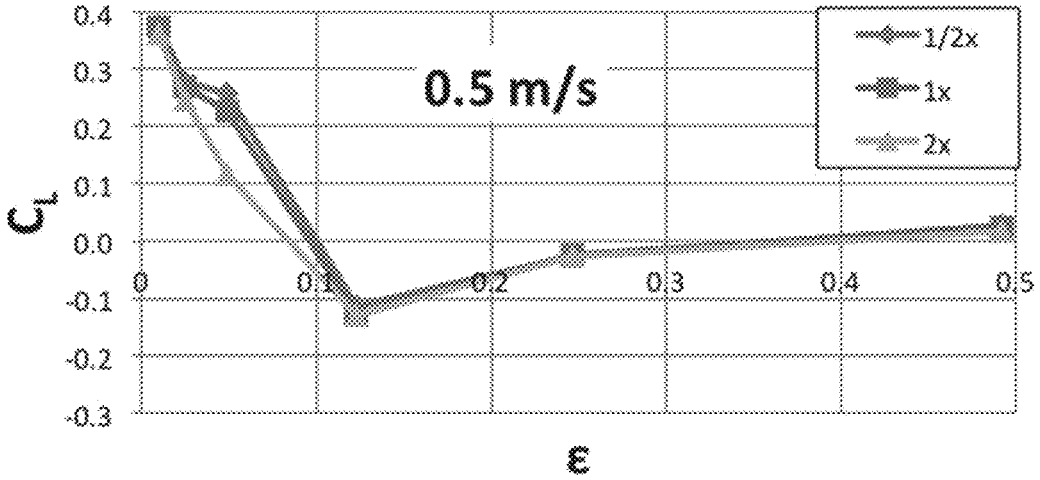
FIG. 25 is a graph of lift coefficients for different size vehicles at different $\varepsilon$ values moved at 0.5 m/s relative to a surface.
Figure 26:
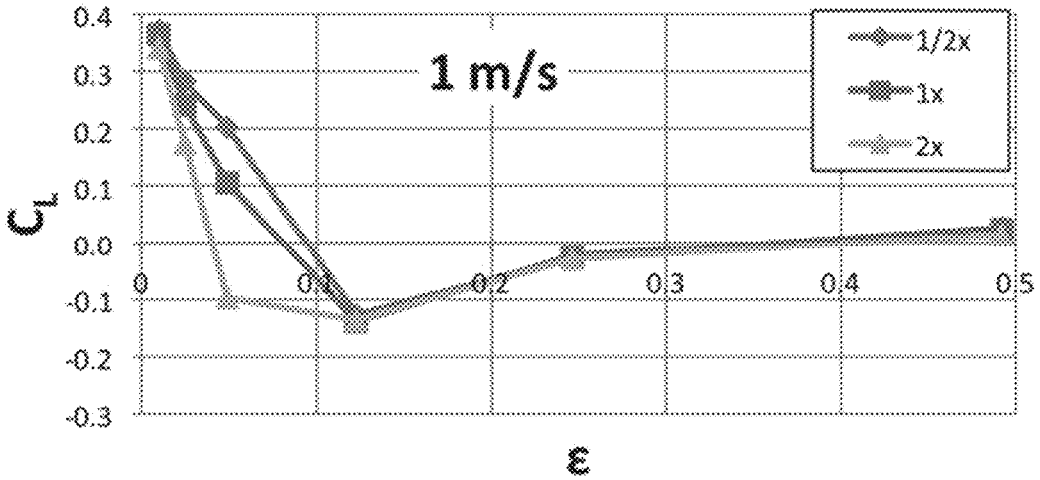
FIG. 26 is a graph of lift coefficients for different size vehicles at different $\varepsilon$ values moved at 1.0 m/s relative to a surface.

Next the effect of size on the dyanamics of a vehicle subjected to ground effect forces was investigated. For this simulation, all dimensions were scaled by a constant of ½ and 2 as compared to the normal 1× size vehicle. FIGS. 25 and 26 present the calculated dimensionless lift coefficients $C_L$ for the different size vehicles at 0.5 m/s and 1.0 m/s. From the figures, $C_L$ appears to be a function of ε but is nearly independent of size and velocity. The observed deviation of $C_L$ at higher velocities and size may correspond to a transition from laminar to turbulent flow through the gap. Using appropriate scaling factors, this means that the force to mass ratio of a vehicle degrades as size increases. However, the maximum velocity perturbation a vehicle may undergo is independent of size if the gap is scaled as well. Furthermore,the resonant frequency goes down for larger sizes, allowing more time for a control system to respond. Additionally, it appears that the ground effect forces and associated slopes increase with size as well, which suggests that it may be desirable to increase a corresponding equilibrium gap of the vehicle as well.

EXAMPLE

Testing of Lateral Movement Induced Ground Effect Forces

Figure 23:
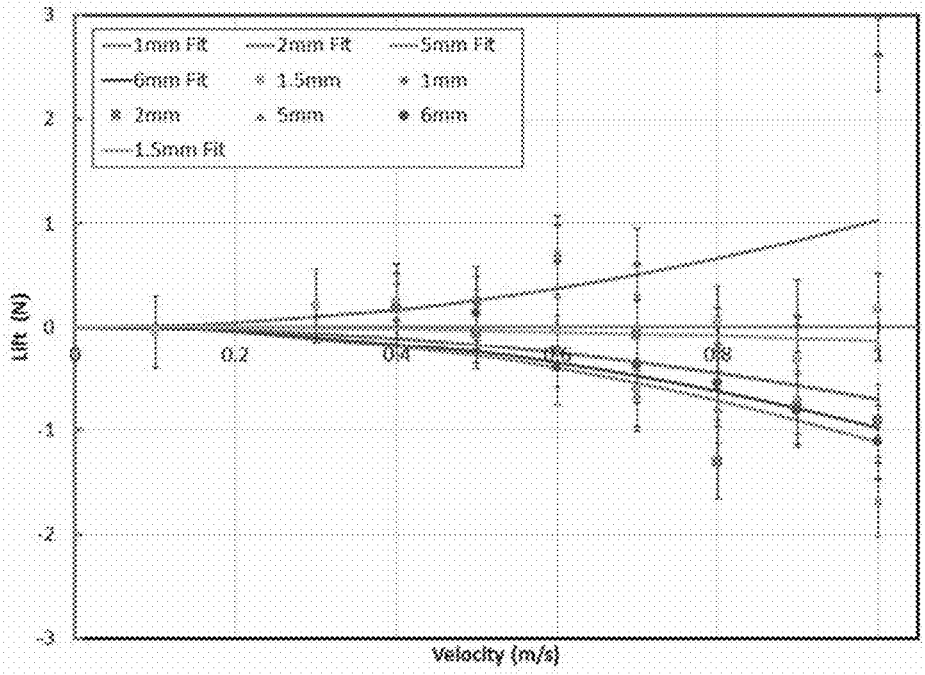
FIG. 23 is a graph of measured lift force versus velocity for different gap sizes.
Figure 27:
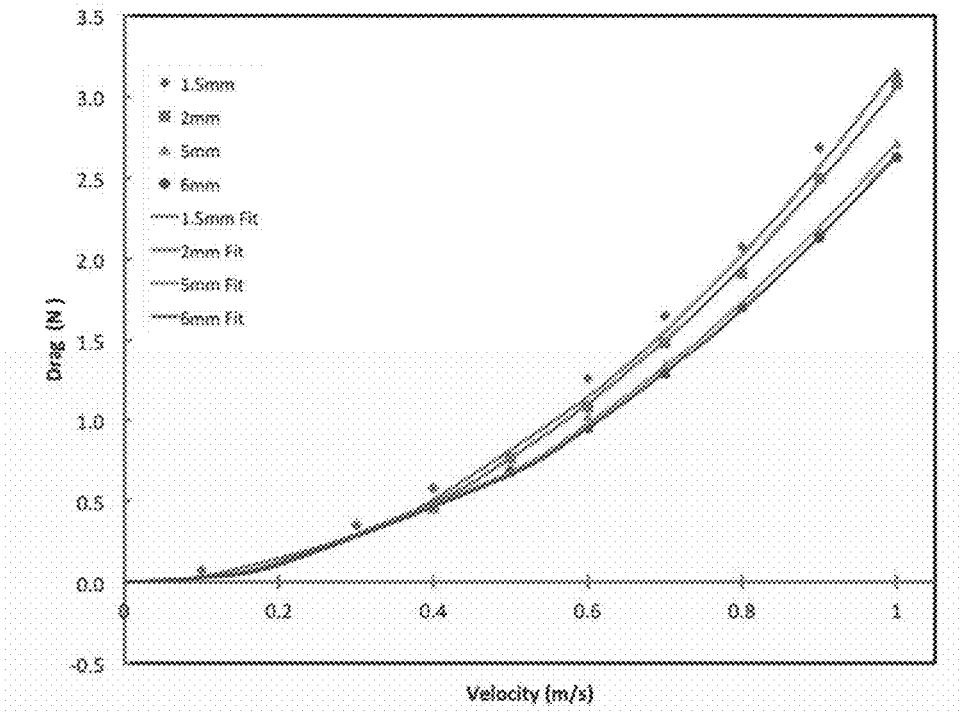
FIG. 27 is a graph of drag versus velocity.

FIG. 23 presents experimental lift force data for a vehicle that was suspended using a hollow steel rod connected to an ATI force and torque sensor within a water filled tow tank. Various tests were run at gaps of 1 mm, 1.5 mm, 2 mm, 5 mm and 6.5 mm from a table, as well as in free stream. The test speeds were varied from 0.1 m/sec to 1 m/sec, plus stationary. Both the drag and lift forces were measured and compared with the CFD results shown in FIG. 22. FIG. 23 presents the measured lift forces minus the free stream forces to facilitate comparison with the corresponding CFD data. The measured experimental data points from varying velocity and gap were overlaid with a quadratic fit for force versus velocity. The most prominent feature shown in FIG. 23 is the lift at a 1 mm gap, particularly at a 1 m/sec velocity. However, forces are quite small at 1.5 mm for all velocities. Above 1.5 mm, negative lift (Venturi effect) occurs. Over 6 mm, this negative force starts fading out. FIG. 27 presents the corresponding experimental data for drag force $F_x$ at different gaps and velocities overlaid with a quadratic fit.

Figure 28:
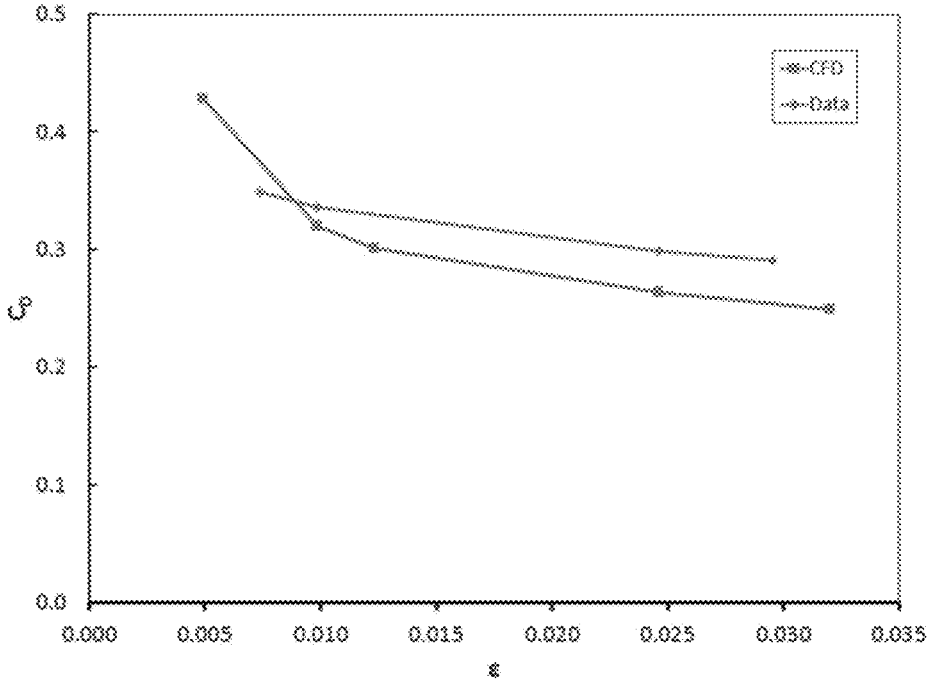
FIG. 28 is a graph of the coefficient of drag for different $\varepsilon$ values.
Figure 29:
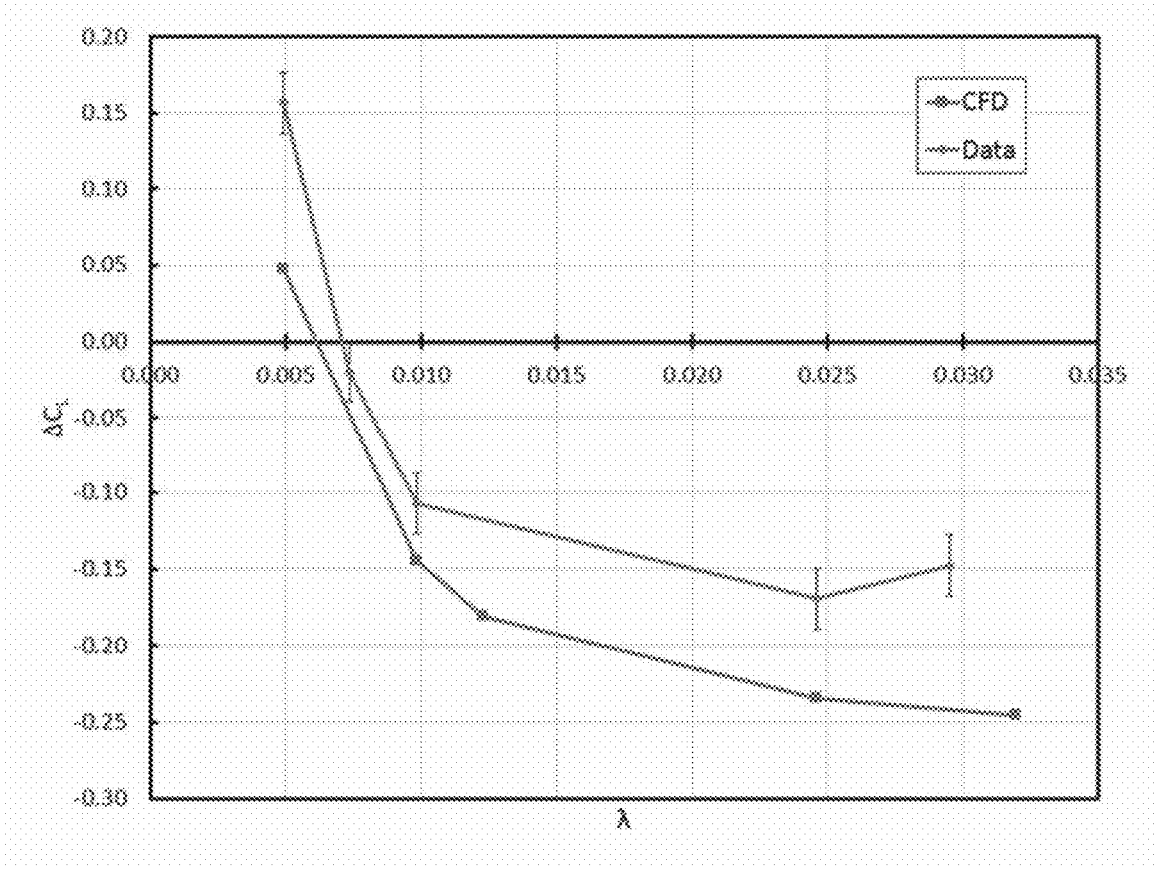
FIG. 29 is a graph of the coefficient of lift versus $\lambda$.

FIGS. 28 and 29 present comparisons of drag and lift coefficients calculated from CFD and the above noted experimental data which are in good agreement.

EXAMPLE

Vehicle for Testing of Jet Induced Ground Effect Forces

Figure 30:
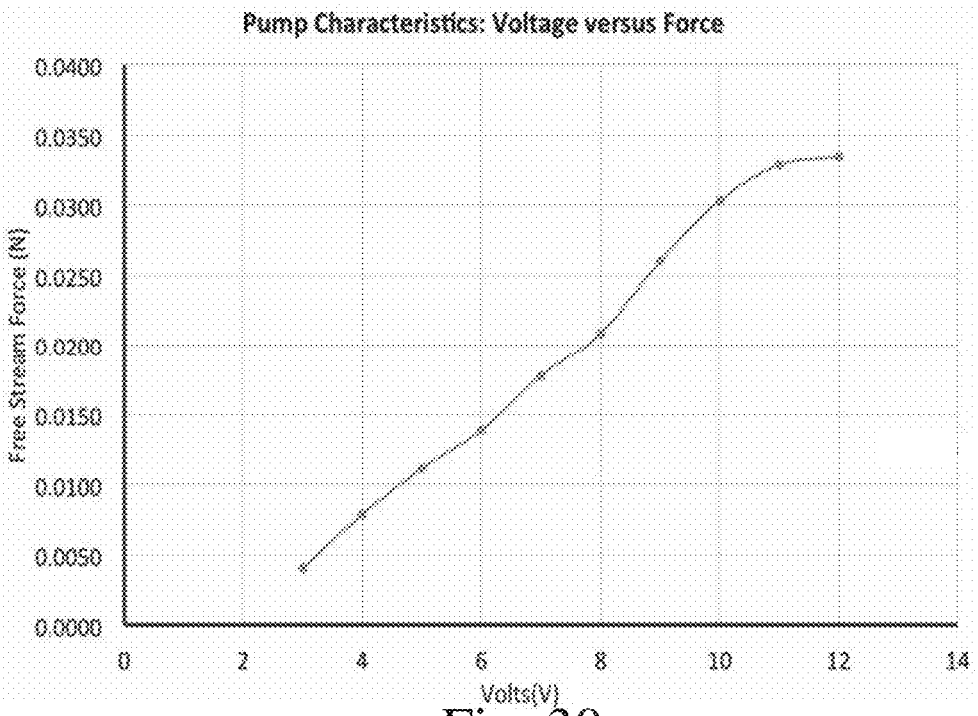
FIG. 30 is a graph of free stream force for a pump versus applied voltage.

The vehicle had an ellipsoidal hull with a single 5 mm diameter, cylindrical nozzle located at the center bottom of the vehicle. A simple centrifugal pump powered at 0-12V was mounted inside and the flow passed through a short tube (15 mm length) to the nozzle. Voltage versus flow characteristics for the pump are shown in FIG. 30. The pump's effective working region was 3-12V with a maximum head pressure of 30 kPa at 12V. For these experiments, the vehicle had a net submersed weight of 3 gf (gram force) or 0.03 N underwater. In free stream the jet produced a force between 0.0007N (at 3V) and 0.036N (at 12V). Thus there is one, and only one, setting where the jet thrust alone exactly counters the downward force from the weight. This is an equilibrium condition for any depth far from a surface. The behavior here is similar to that of a neutrally buoyant body. Therefore, a small increase in thrust causes the vehicle to rise and a small decrease causes it to sink. Thus it is in a neutral equilibrium state.

EXAMPLE

Testing of Jet Induced Ground Effect Forces

FIG. 31 presents the lift force versus gap distance from a surface for the pump working at 12V (i.e. 0.036 N). As seen in the figure, the vehicle transitions from a fluid film based behavior where pressure is building up under the vehicle to levels greater than the free stream thrust force in region 1 to region 2 where jet induced lift losses begin to dominate reducing the lift force until it reaches a maximum suck down. Fountain effects then begin to dominate causing the lift force to increase to greater than the free stream thrust force in region 3. The lift force then decays to the free stream thrust force at larger distances in the free stream condition.

EXAMPLE

Simulation of Jet Induced Ground Effect Forces

Figure 32:
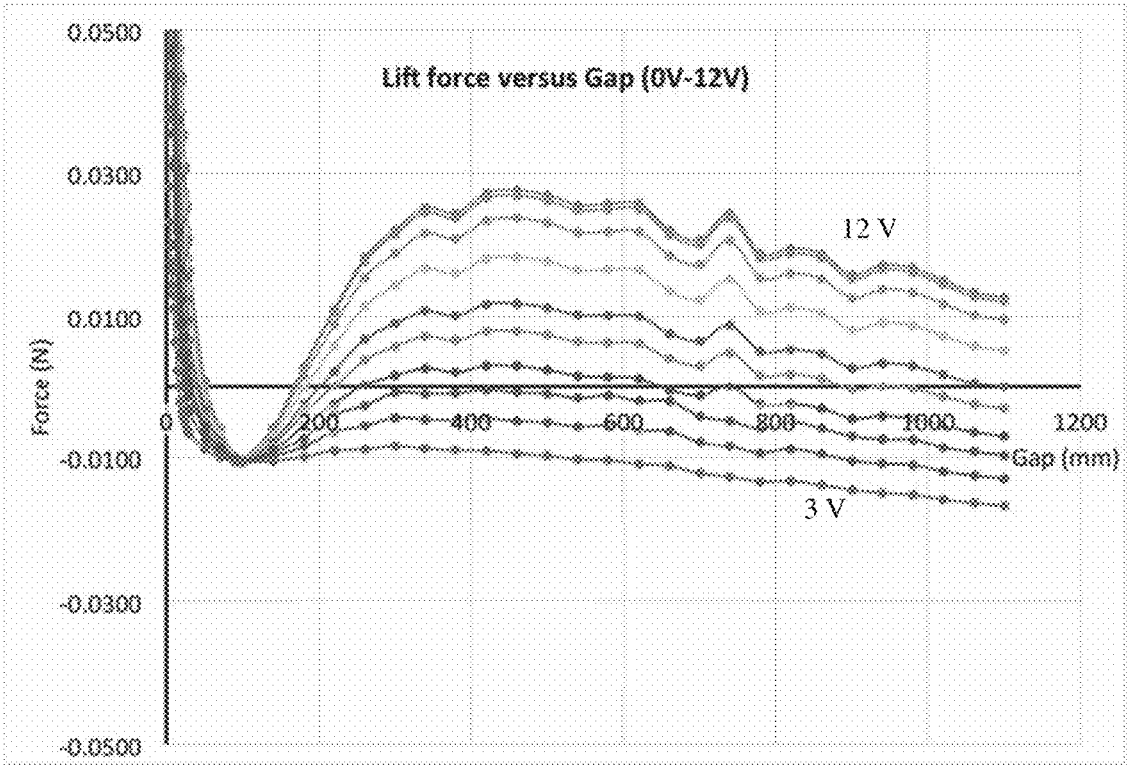
FIG. 32 is a graph of calculated force applied by a thruster to a vehicle at different gap values relative to a surface for different applied thruster voltages.
Figure 33:
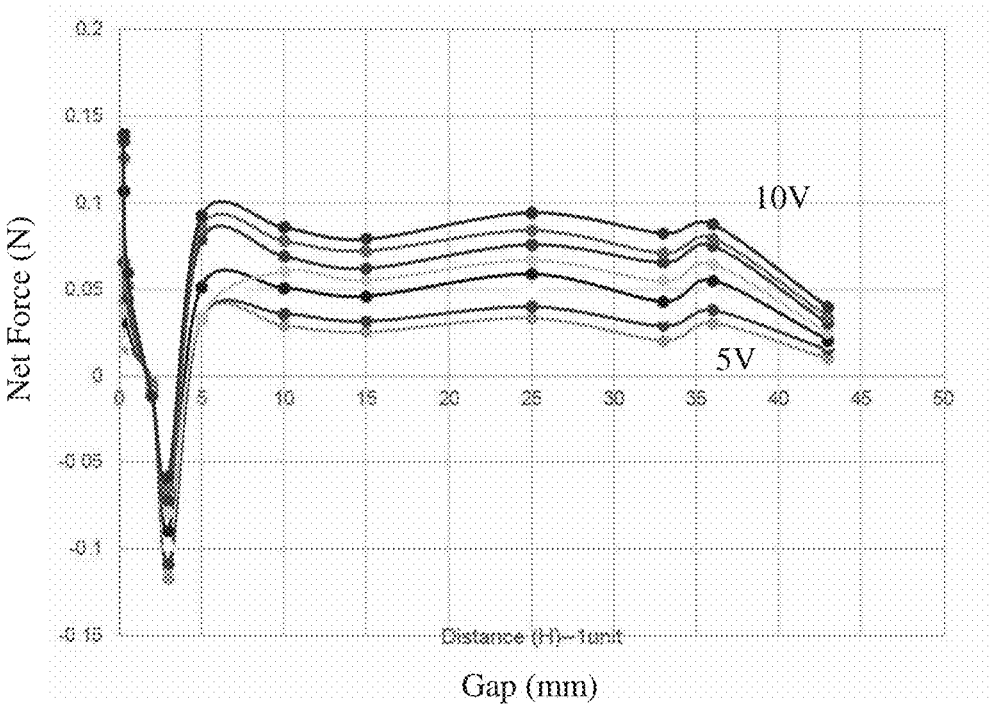
FIG. 33 is a graph of experimental force applied by a thruster to a vehicle at different gap values relative to a surface for different applied thruster voltages.

Since lubrication theory is relatively well understood, the simulations were restricted to a turbulent flow model of a jet oriented downwards towards a surface in an underwater environment somewhat similar to a vertical and take-off and landing simulation. The model was set up using CFX, the standard static CFD software from ANSYS. Turbulence was handled by the κ-ε model. The mesh was generated using "Proximity and Curvature" for the advanced size function, resulting in a dense mesh around the vehicle bottom, particularly when close to a surface. The pump is represented by an inlet at the top of a pipe, with the inlet flow rate set to match the measured properties of the pump noted above. The simulations confirmed the suck down phenomenon for a flow rate corresponding to full power (12V) at gap sizes of 100 mm and 20 mm respectively. Specifically, the expected downward flow under the body, and for small gaps, a low-pressure region beneath body that forms a ground vortex, are both observed. The simulations also confirmed that the up wash from a jet impinging on a surface changes direction and escapes out from the edges of the undersurfaces of the vehicle giving rise to the observed additional lift from the fountain effect FIG. 32 presents the calculated lift force versus gap distance from a surface for different voltages applied to the pump, and correspondingly different jet velocities. As seen in the figure, the lift force curves exhibit behavior that is similar to that shown in FIG. 31. However as the voltage is lowered, i.e. lower jet velocities, the peak fountain effect force steadily decreases and moves to smaller gap sizes until the fountain effect is dominated by suction at low enough voltages/velocities. FIG. 32 presents similar data for measured net lift force versus gap distance from a surface for different voltages applied to the pump ranging between 5 V and 10 V in 1 V increments.

Note FIG. 32 includes a correction for varying cable length (for pump power) immersed in the water. The rigidity of the cable is however not included in the model. Thus, although there is qualitative agreement with the measurement, a stable equilibrium at a distance which varies with pump power, as calculated with the model does not quantitatively agree with the measured stable distances and corresponding voltage as is to be expected.

EXAMPLE

Measuring a Vehicle Stable Point

A vehicle with a net weight of 3 gmf was placed on the floor of a tank in 2 ft of water. Being heavier than water, the body stayed in contact with the tank bottom surface. When the bottom jet was powered at 3 Volts, the vehicle still stayed in contact with the surface. As the voltage was raised, the vehicle had a tendency to rock which was interpreted as being due to imperfect mating of the two surfaces. The fluid oozed out of the nozzle and formed a film below the vehicle. This was evident when the vehicle was lightly tapped. With the jet off, the vehicle would barely move. In contrast, with the jet powered, the vehicle moved smoothly and for considerable distance illustrating a simple demonstration of lubrication theory where both the lubrication fluid and the medium of propagation are water.

Figure 34:
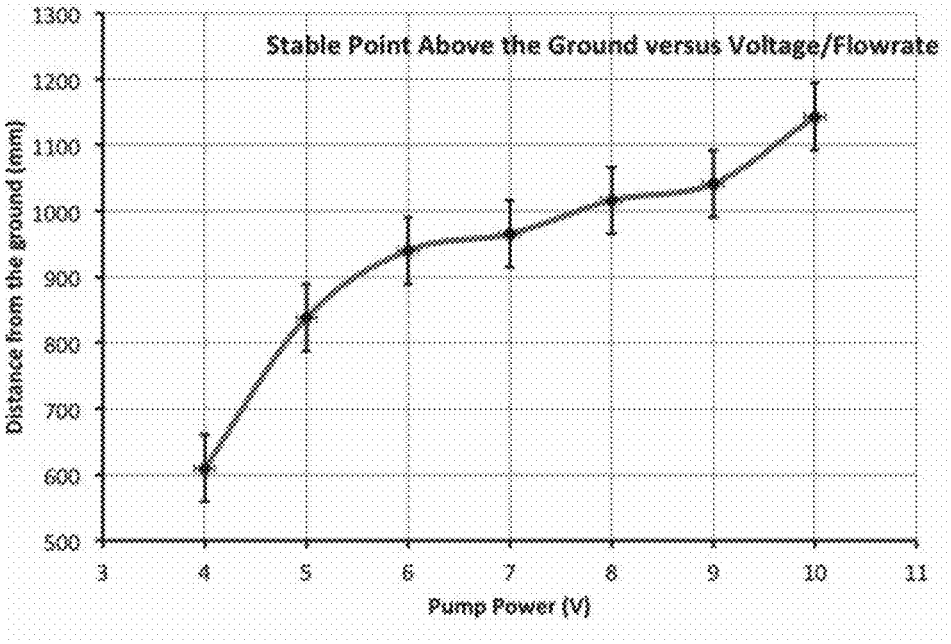
FIG. 34 is a graph of stable equilibrium distances versus different applied thruster voltages.
Figure 35:
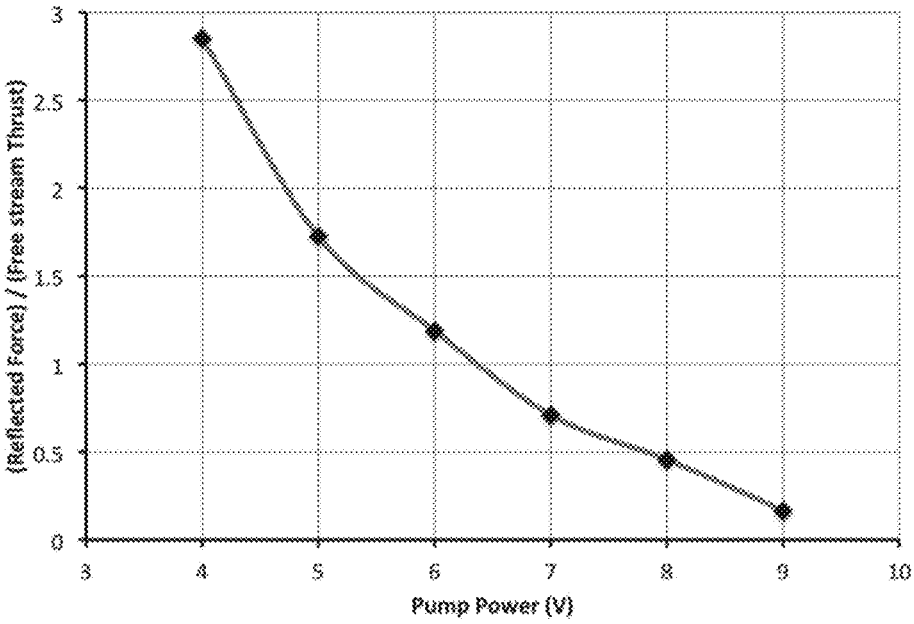
FIG. 35 is a graph of a normalized reflected force versus applied thruster power.

Next the vehicle was attached to a force sensor and suspended above the floor of a 5 ft deep tank. An ultrasonic range finder was used to measure the distance between the vehicle and the floor. At 4.5 ft above the floor, and with the pump powered at 10V, the jet's thrust balanced the weight of the robot, i.e. the force sensor read zero. To check if the vehicle behavior was dominated by ground effects, the vehicle was lowered to a 4 ft depth while keeping the pump powered at 10V. the vehicle maintained a neutral equilibrium at that height as well, indicating the ground was not a dominant factor. However at 3.5 ft the vehicle experienced an upward force pushing it back up to 4 ft. Further, when the vehicle was again placed at 4.5 ft and the voltage was decreased to 8 volts, the vehicle started sinking, as expected, but subsequently stabilized at 3.5 ft. As the voltage was further decreased the vehicle correspondingly sank to new stable equilibrium points relative to the surface. This was observed down to 4V, at which setting the vehicle stabilized 2 ft from the surface. These measurements were repeat over 5 runs. The measured stable equilibrium points versus pump voltage are shown in FIG. 34. Additionally, the free stream thrust at each voltage was calculated using the pump characteristics which was then used to calculate the corresponding up wash force at each stable point which was then normalized to the thrust as shown in FIG. 35.

EXAMPLE

Control Thruster Design

Figure 36:
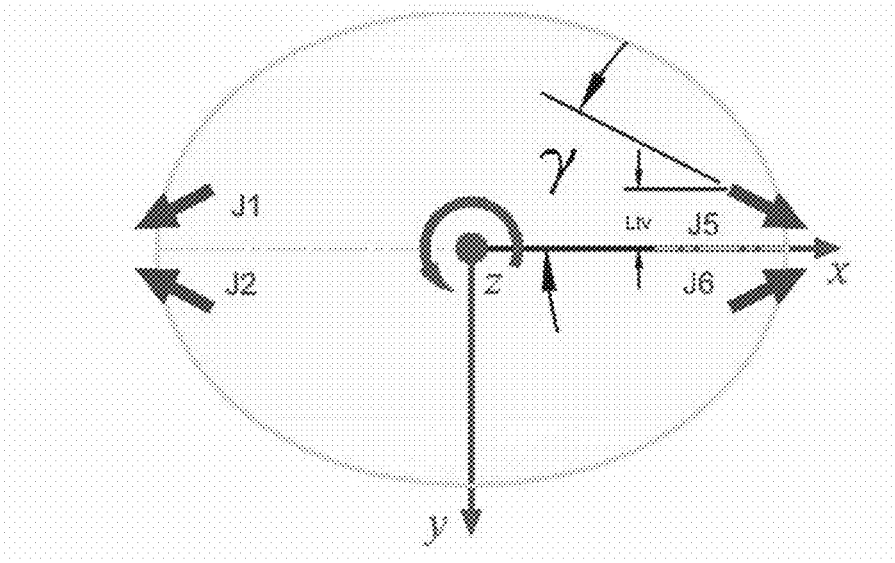
FIG. 36-FIG. 37 are top and side views of a vehicle showing force directions from thrusters.
Figure 37:
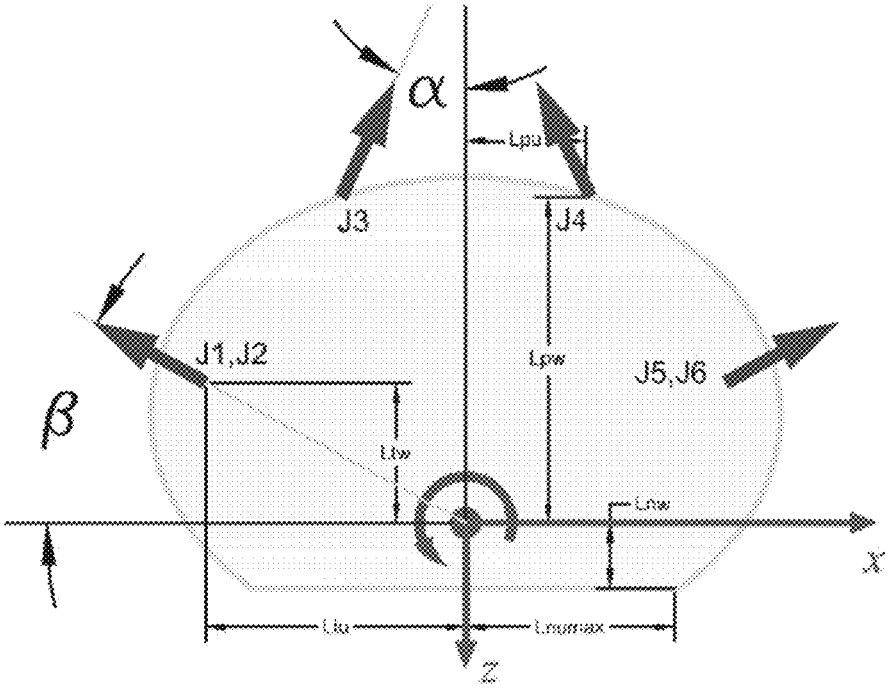

FIGS. 36 and 37 depict the thruster layout for an ellipsoidal vehicle of dimensions 203 mm×152 mm with a flat bottom. The result aspect ratio is approximately 4:3 which may improve the controllability of the vehicle. Of course, the size can be adjusted either smaller or larger to accommodate various types of electronics and sensors. As shown in the figures, the vehicle has 6 thrusters, or jets. Specifically, there are four 'propulsion jets' (J1, J2, J5, J6) and two 'pressure jets' (J3, J4). The propulsion jets are oriented at an inward angle of $\gamma$ in the xy plane which governs the yaw-sway dynamics of the system. A non-zero $\gamma$ may help improve controllability of the system in the absence of friction, though a zero angle may also be used. For stability on a horizontal surface, which was the initial test case, the center of gravity (CG) of the vehicle was located below the center of buoyancy. This was done by placing ballast at the bottom of the robot. For more complex cases (e.g. inspecting a vertical wall, or going around a pipe) it may be desirable to adjust the CG location as described previously. Note jets J1, J2, J5 and J6 may be oriented at an angle $\beta$ such that they pass through the CG of the system. This may help reduce or eliminate thrust induced pitching of the vehicle. However friction or surface curvature might still demand active pitch control of the vehicle. This pitch control may be provided using two pressure jets J3 and J4 oriented vertically upwards at an angle of $\alpha$ as shown in FIG. 37.

Two vehicles with different jet arrangements were tested in a contact mode with a surface where the vehicle was traversed over the surface while in contact with the surface.

Figure 38:
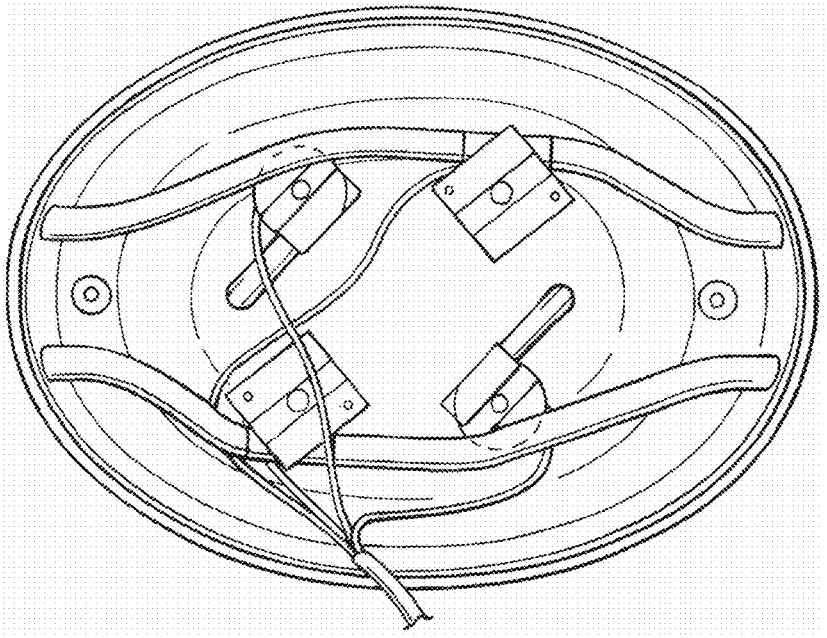
FIG. 38-FIG. 39 are exterior and interior pictures of a submersible vehicle.
Figure 39:
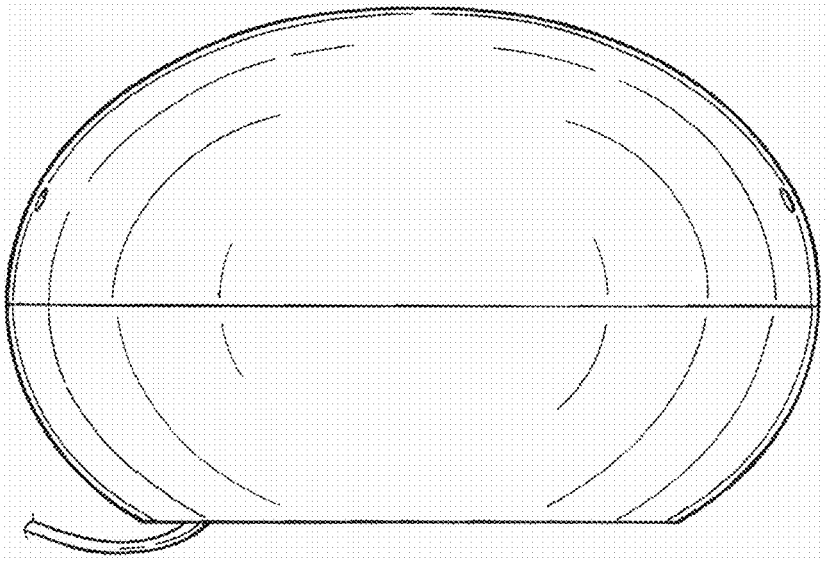
Figure 40:
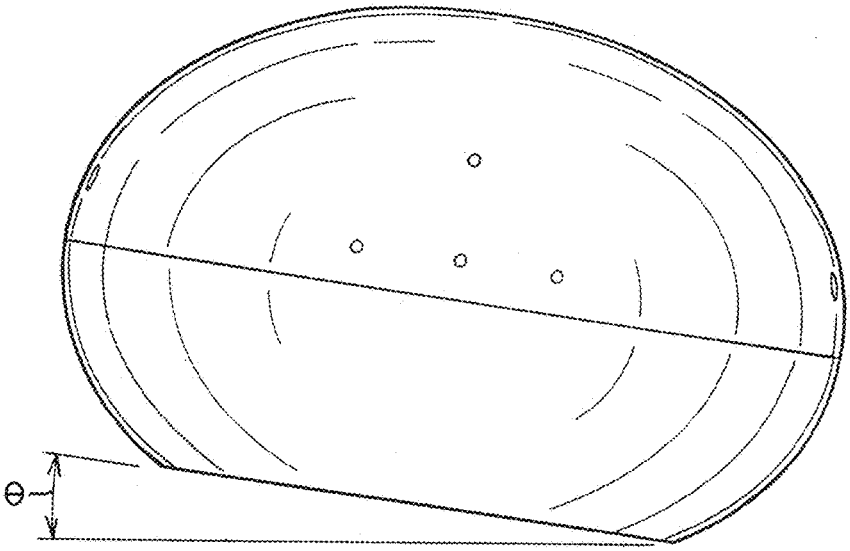
FIG. 40-FIG. 41 are pictures of a vehicle subjected to a nose down pitching moment.
Figure 41:
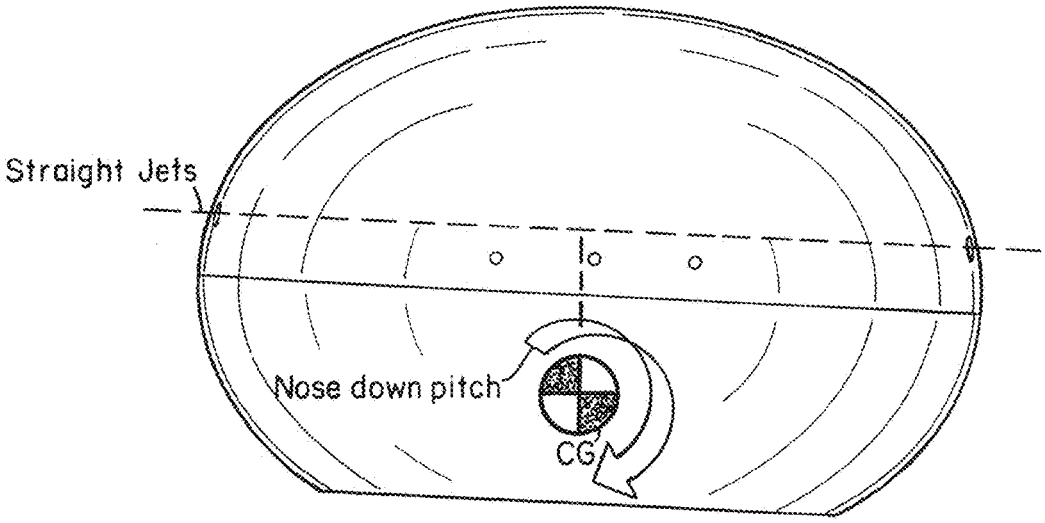

The first vehicle with two unangled pressure jets and four unangled propulsion jets was tested by making it slightly heavier than neutral buoyancy and putting it on a horizontal surface under water. FIGS. 38 and 39 are photographs of the exterior and interior of the vehicle. In the pictures, the vehicle has an ellipsoidal hull with a flat bottom and the unangled jets are distributed around its surface. The interior picture shows the layout of the pumps, valves, and hydraulic connections used for powering the four propulsion jets. During testing, when jets J1 and J2 were turned on to propel the vehicle in a horizontal direction, the vehicle instead of going forward suffered a nose down pitch and went in circles. In FIGS. 40 and 41 the vehicle can be seen in the nose down pitched position at a small angle $\theta$ as the vehicle yaws. Without wishing to be bound by theory, this first vehicle had jets that came out straight and therefore the length of the moment arm to the center of gravity gave rise to a pitch down moment. The frictional force from the ground contact also contributed to the pitch down moment. Further, due to the lateral velocity of the vehicle relative to the surface being small, the drag could not compensate for this effect. Therefore, the Munk moment, combined with accidental sideslip perturbations, resulted in a constant yaw rate and the vehicle was observed to go in circles.

Figure 42:
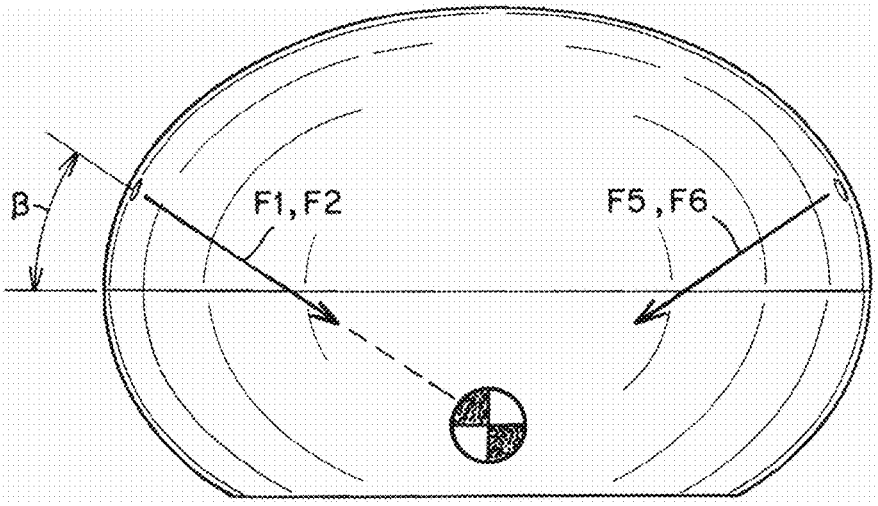
FIG. 42 and FIG. 43 are pictures of a vehicle including angled control jets.
Figure 43:
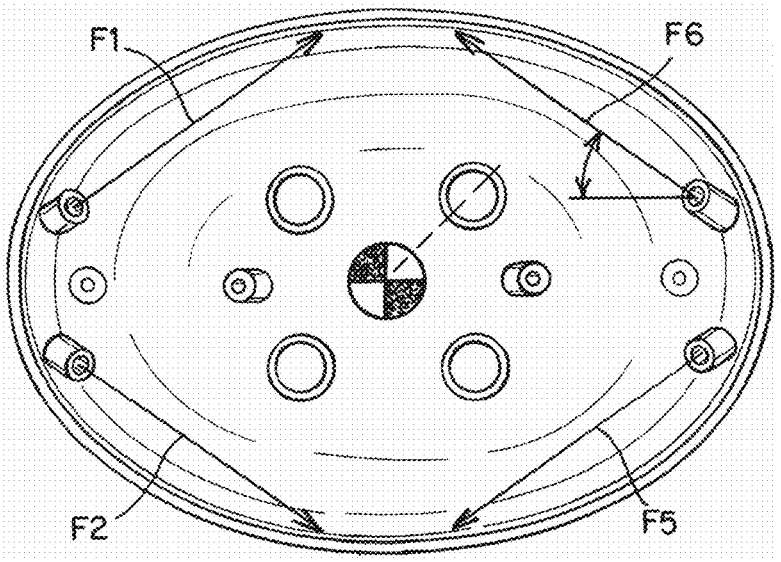
Figure 44:
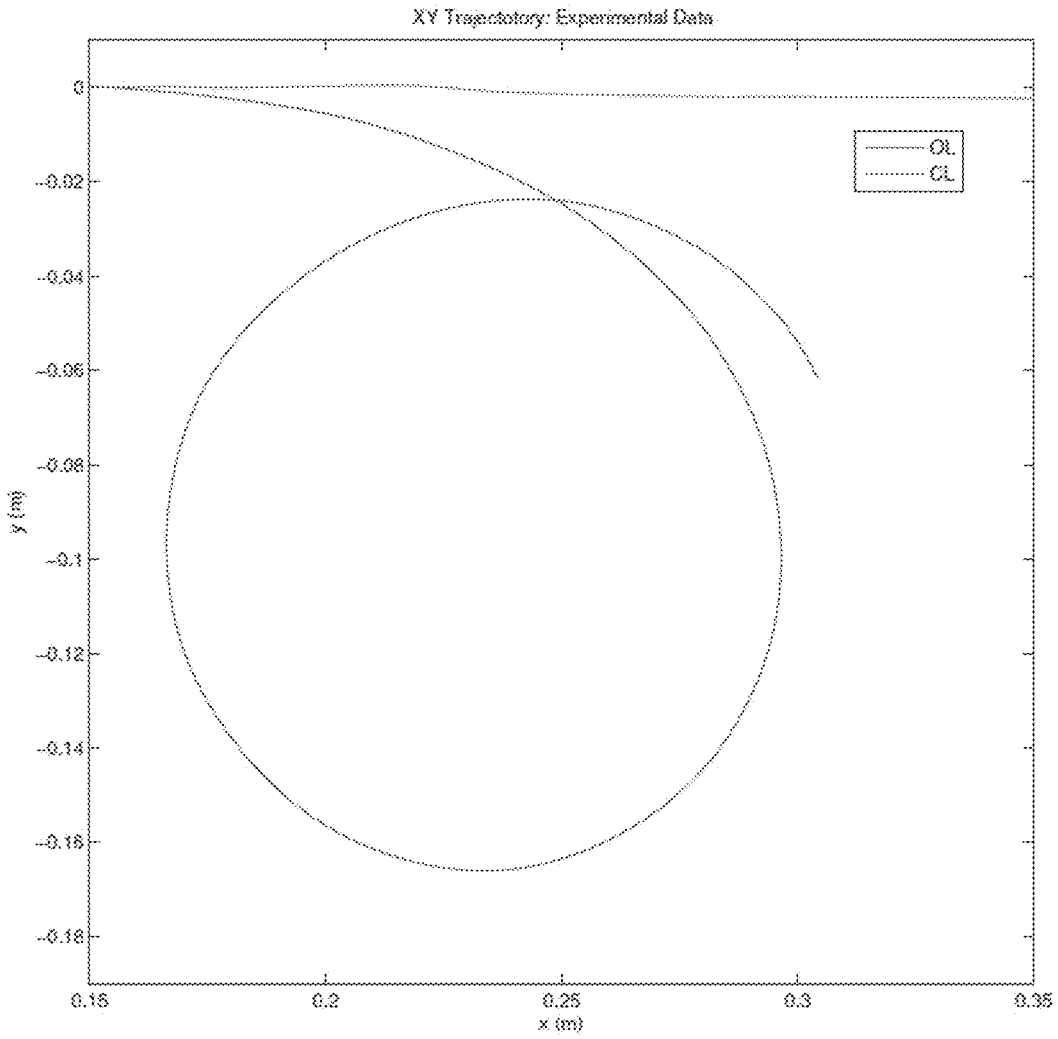
FIG. 44 is a graph of vehicle trajectory for open and closed loop control.

A second vehicle tested also included propulsion and pressure jets as discussed above. Additionally, to help counter the thrust induced pitching observed in the first vehicle, the jets were oriented at an angle $\beta$ to reduce the moment arm of the propulsions jets relative to the CG. For simplicity $\beta$ was chosen such that the force vectors passed through the estimated center of gravity of the vehicle thereby minimizing the pitch otherwise caused by placing the jets in the upper half of the vehicle, see FIGS. 42 and 43. During testing, the vehicle did not pitch when jets 1 and 2 were turned on. However, the vehicle did yaw due to the Munk moment. To help compensate for this effect, a simple PD controller and check on the closed loop response was implemented. FIG. 44 shows the comparison of the closed loop and open loop trajectory of the vehicle on a low friction glass surface ($\mu_k$<0.3). As seen in the figure, for the given friction, a simple PD controller was able to control the heading angle successfully. For very high friction, one should note that the Munk moment would face a breaking torque that would substantially reduce the yaw rate.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A method of controlling a vehicle immersed in a fluid, the method comprising:

positioning the vehicle immersed in the fluid at a first preselected distance relative to a surface; and generating a ground effect force that acts on the vehicle to maintain the vehicle at the first preselected distance, wherein generating the ground effect force comprises applying a thrust to the vehicle with a plurality of thrusters oriented towards the surface, wherein the plurality of thrusters are located on a flat portion of the vehicle, wherein the plurality of thrusters are angled inwards towards a common point on an axis passing perpendicularly through the flat portion of the vehicle, and wherein the ground effect force biases the vehicle towards the first preselected distance relative to the surface when the vehicle is displaced relative to the surface.

2. The method of claim 1, wherein generating the ground effect force includes moving the vehicle laterally relative to the surface.

3. The method of claim 1, wherein a net weight of the vehicle and the ground effect force result in substantially net zero force applied to the vehicle in a direction oriented towards the surface when the vehicle is at the first preselected distance.

4. The method of claim 1, further comprising altering the ground effect force to move the vehicle from the first preselected distance relative to the surface to a second preselected distance relative to the surface.

5. The method of claim 1, further comprising scanning the surface with a sensor as the vehicle is moved laterally relative to the surface.

6. The method of claim 5, wherein the first preselected distance is within a desired sensing range of the sensor.

7. The method of claim 1, further comprising applying a thrust to the vehicle that biases the vehicle towards the surface, wherein a net weight of the vehicle, the thrust towards the surface, and the ground effect force result in a substantially net zero force applied to the vehicle in a direction oriented towards the surface when the vehicle is at the first preselected distance.

8. The method of claim 1, wherein when the vehicle is maintained at the first preselected distance, a ratio of the first preselected distance and a chord length of the flat portion of the vehicle oriented towards the surface is greater than or equal to about 0.001 and less than or equal to about 0.3.

9. The method of claim 1, wherein, when the vehicle is maintained at the first preselected distance, a ratio of the first preselected distance and a diameter of one of the thrusters of the plurality of thrusters is greater than or equal to 0.6 and less than or equal to 64.

10. The method of claim 1, further comprising applying a thrust to the vehicle along an axis that passes through a center of gravity of the vehicle and is parallel to both the surface and the flat portion.

11. A method of controlling a vehicle immersed in a fluid, the method comprising:

generating a ground effect force that acts on the vehicle at a first stable equilibrium distance of the vehicle relative to a surface such that the ground effect force biases the vehicle towards the first stable equilibrium distance when it is displaced relative to the surface, wherein generating the ground effect force comprises both moving the vehicle laterally relative to the surface and applying a thrust to the vehicle with a plurality of thrusters oriented towards the surface, wherein the plurality of thrusters are located on a flat portion of the vehicle, and wherein the plurality of thrusters are angled inwards towards a common point on an axis passing perpendicularly through the flat portion of the vehicle.

12. The method of claim 11, further comprising scanning the surface with a sensor as the vehicle is moved laterally relative to the surface.

13. The method of claim 12, wherein the first stable equilibrium distance is within a desired sensing range of the sensor.

14. The method of claim 11, further comprising altering the ground effect force to move the vehicle from the first stable equilibrium distance relative to the surface to a second stable equilibrium distance relative to the surface.

15. The method of claim 11, further comprising maintaining the vehicle at the first stable equilibrium distance, and wherein a ratio of the first stable equilibrium distance and a chord length of the flat portion of the vehicle oriented towards the surface is greater than or equal to about 0.001 and less than or equal to about 0.3.

16. The method of claim 11, further comprising maintaining the vehicle at the first stable equilibrium distance, and wherein a ratio of the first stable equilibrium distance and a diameter of one of the thrusters of the plurality of thrusters is greater than or equal to 0.6 and less than or equal to 64.

17. The method of claim 11, further comprising applying a thrust to the vehicle along an axis that passes through a center of gravity of the vehicle and is parallel to both the surface and flat portion.

18. A method of controlling a vehicle immersed in a fluid, the method comprising:

orienting a flat portion of the vehicle towards a surface;

applying a thrust to the vehicle that biases the vehicle towards the surface;

generating a ground effect force that acts on the vehicle relative to the surface, wherein generating the ground effect force comprises at least one of moving the vehicle laterally relative to the surface and applying a thrust to the vehicle with a plurality of thrusters oriented towards the surface, wherein the plurality of thrusters are located on the flat portion of the vehicle, wherein the plurality of thrusters are angled inwards towards a common point on an axis passing perpendicularly through the flat portion of the vehicle, and wherein a net weight of the vehicle, a net thrust biasing the vehicle towards the surface, and the ground effect force result in a substantially net zero force applied to the vehicle in a direction oriented towards the surface.

19. The method of claim 18, wherein the net weight of the vehicle, the net thrust biasing the vehicle towards the surface, and the ground effect force result in a substantially net zero force applied to the vehicle in the direction oriented towards the surface when the vehicle is at a first preselected distance relative to the surface.

20. The method of claim 19, wherein the first preselected distance is a first stable equilibrium distance relative to the surface.

21. The method of claim 18, wherein orienting the flat portion of the vehicle towards the surface further comprises adjusting a center of gravity of the vehicle to orient the flat portion of the vehicle towards the surface.

22. The method of claim 18, wherein generating the ground effect force includes applying the thrust to the vehicle with the plurality of thrusters oriented towards the surface.

23. The method of claim 18, wherein generating the ground effect force includes both moving the vehicle laterally relative to the surface and applying the thrust to the vehicle with the plurality of thrusters oriented towards the surface.

24. The method of claim 18, further comprising scanning the surface with a sensor as the vehicle is moved laterally relative to the surface.

25. The method of claim 18, further comprising maintaining the flat portion of the vehicle at a distance relative to the surface, and wherein a ratio of the distance from the flat portion of the vehicle to the surface and a chord length of the flat portion is greater than or equal to about 0.001 and less than or equal to about 0.3.

26. The method of claim 18, further comprising maintaining the flat portion of the vehicle at a distance relative to the surface, and wherein a ratio of the distance from the flat portion of the vehicle to the surface and a diameter of one of the thrusters in the plurality of thrusters is greater than or equal to 0.6 and less than or equal to 64.

27. The method of claim 18, further comprising applying a thrust to the vehicle along an axis that passes through a center of gravity of the vehicle and is parallel to both the surface and flat portion.

28. The method of claim 18, wherein generating the ground effect force includes moving the vehicle laterally relative to the surface.

* * * * *